US009513039B2

(12) United States Patent
Numata et al.

(10) Patent No.: US 9,513,039 B2
(45) Date of Patent: Dec. 6, 2016

(54) HEAT EXCHANGER

(75) Inventors: Mitsuharu Numata, Plymouth, MN (US); Kazushige Kasai, Minnetonka, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 781 days.

(21) Appl. No.: 13/453,352

(22) Filed: Apr. 23, 2012

(65) Prior Publication Data

US 2013/0277018 A1 Oct. 24, 2013

(51) Int. Cl.

| | |
|---|---|
| ***F28D 5/02*** | (2006.01) |
| ***F28D 3/02*** | (2006.01) |
| ***F25B 39/02*** | (2006.01) |
| ***F28D 3/04*** | (2006.01) |

(52) U.S. Cl.

CPC ..... *F25B 39/02* (2013.01); *F28D 3/02* (2013.01); *F28D 3/04* (2013.01); *F25B 2339/0242* (2013.01); *F25B 2341/0012* (2013.01); *F28D 5/02* (2013.01)

(58) Field of Classification Search

CPC ..... F28D 5/02; F28D 3/02; F28D 3/04; F25B 39/028; F25B 2339/0242; B05B 1/14; B05B 1/20; B05B 1/205; B05B 1/207; B05B 13/02; B05B 13/0285; B05B 15/06; B05B 15/061

USPC ... 165/111, 112, 114, 115, 117, 160; 62/515, 525, 527; 239/450, 566, 282, 283, 239/268

See application file for complete search history.

(56) References Cited

U.S. PATENT DOCUMENTS

| | | | | |
|---|---|---|---|---|
| 939,143 | A * | 11/1909 | Lillie | F28D 3/02 165/117 |
| 5,588,596 | A | 12/1996 | Hartfield et al. | |
| 5,645,124 | A | 7/1997 | Hartfield et al. | |
| 6,167,713 | B1 | 1/2001 | Hartfield et al. | |
| 6,253,571 | B1 * | 7/2001 | Fujii et al. | 62/484 |
| 6,606,882 | B1 | 8/2003 | Gupte | |

(Continued)

FOREIGN PATENT DOCUMENTS

| | | |
|---|---|---|
| CN | 1249032 A | 3/2000 |
| JP | 60-43966 U | 3/1985 |

(Continued)

OTHER PUBLICATIONS

Office Acton for the corresponding Chinese application No. 201380021198.5, issued on Dec. 16, 2015.

*Primary Examiner* — Leonard R Leo

(74) *Attorney, Agent, or Firm* — Global IP Counselors, LLP

(57) ABSTRACT

A heat exchanger includes a shell, a refrigerant distribution assembly and a heat transferring unit. The refrigerant distribution assembly includes a first tray part and second tray parts. The first tray part continuously extends generally parallel to the longitudinal center axis of the shell to receive a refrigerant that enters the shell. The second tray parts are disposed below the first tray part to receive the refrigerant discharged from first discharge apertures such that the refrigerant accumulated in the second tray parts does not communicate between the second tray parts. The second tray parts are aligned along a direction generally parallel to the longitudinal center axis of the shell. The heat transferring unit is disposed below the second tray parts so that the refrigerant discharged from second discharge apertures of the second tray parts is supplied to the heat transferring unit.

21 Claims, 25 Drawing Sheets

(56) References Cited

U.S. PATENT DOCUMENTS

| | | | | |
|---|---|---|---|---|
| 6,830,099 | B2 | 12/2004 | Moeykens | |
| 6,868,695 | B1 | 3/2005 | Dingel et al. | |
| 7,849,710 | B2 | 12/2010 | De Larminat et al. | |
| 2002/0162352 | A1* | 11/2002 | Ring et al. | 62/515 |
| 2008/0149311 | A1 | 6/2008 | Liu et al. | |
| 2009/0178790 | A1 | 7/2009 | Schreiber et al. | |
| 2010/0319395 | A1 | 12/2010 | De Larminat et al. | |
| 2011/0056664 | A1 | 3/2011 | De Larminat et al. | |

FOREIGN PATENT DOCUMENTS

| | | | |
|---|---|---|---|
| JP | 61-125588 | A | 6/1986 |
| JP | 09-061080 | A | 3/1997 |
| JP | 3364818 | B2 | 1/2003 |
| JP | 2003-517560 | A | 5/2003 |
| JP | 2007-198700 | A | 8/2007 |
| JP | 2008-516187 | A | 5/2008 |
| JP | 2011-510248 | A | 3/2011 |
| WO | 98/41798 | A1 | 9/1998 |

* cited by examiner

HEAT EXCHANGER

BACKGROUND OF THE INVENTION

Field of the Invention

This invention generally relates to a heat exchanger adapted to be used in a vapor compression system. More specifically, this invention relates to a heat exchanger including a refrigerant distributor having a first tray part and a plurality of second tray parts.

Background Information

Vapor compression refrigeration has been the most commonly used method for air-conditioning of large buildings or the like. Conventional vapor compression refrigeration systems are typically provided with an evaporator, which is a heat exchanger that allows the refrigerant to evaporate from liquid to vapor while absorbing heat from liquid to be cooled passing through the evaporator. One type of evaporator includes a tube bundle having a plurality of horizontally extending heat transfer tubes through which the liquid to be cooled is circulated, and the tube bundle is housed inside a cylindrical shell. There are several known methods for evaporating the refrigerant in this type of evaporator. In a flooded evaporator, the shell is filled with liquid refrigerant and the heat transfer tubes are immersed in a pool of the liquid refrigerant so that the liquid refrigerant boils and/or evaporates as vapor. In a falling film evaporator, liquid refrigerant is deposited onto exterior surfaces of the heat transfer tubes from above so that a layer or a thin film of the liquid refrigerant is formed along the exterior surfaces of the heat transfer tubes. Heat from walls of the heat transfer tubes is transferred via convection and/or conduction through the liquid film to the vapor-liquid interface where part of the liquid refrigerant evaporates, and thus, heat is removed from the water flowing inside of the heat transfer tubes. The liquid refrigerant that does not evaporate falls vertically from the heat transfer tube at an upper position toward the heat transfer tube at a lower position by force of gravity. There is also a hybrid falling film evaporator, in which the liquid refrigerant is deposited on the exterior surfaces of some of the heat transfer tubes in the tube bundle and the other heat transfer tubes in the tube bundle are immersed in the liquid refrigerant that has been collected at the bottom portion of the shell.

Although the flooded evaporators exhibit high heat transfer performance, the flooded evaporators require a considerable amount of refrigerant because the heat transfer tubes are immersed in a pool of the liquid refrigerant. With recent development of new and high-cost refrigerant having a much lower global warming potential (such as R1234ze or R1234yf), it is desirable to reduce the refrigerant charge in the evaporator. The main advantage of the falling film evaporators is that the refrigerant charge can be reduced while ensuring good heat transfer performance. Therefore, the falling film evaporators have a significant potential to replace the flooded evaporators in large refrigeration systems.

In general, the rate of heat transfer between a surface (e.g., a surface of a heat transfer tube) and a substance (e.g., refrigerant) in a liquid state is much greater than the rate of heat transfer between the surface and the same substance in a gaseous state. Therefore, it is important for effective and efficient heat transfer performance to keep the tubes in the evaporator covered, or wetted, with liquid refrigerant during operation. With a flooded evaporator in which the tubes are immersed in a pool of the liquid refrigerant, performance of the evaporator can be maintained without significant degradation by controlling the liquid level within the evaporator shell even when the refrigerant circulation condition fluctuates. However, in a falling film evaporator, if all of refrigerant evaporates at an upper region of the tube bundle before it reaches a lower region, the lower tubes are left unwetted, thereby incapable of affecting heat transfer. Therefore, it is especially important in a falling film evaporator that there be a sufficient flow of liquid refrigerant over the tube bundle even when the refrigerant circulation condition fluctuates.

U.S. Patent Application Publication No. 2009/0178790 discloses a falling film evaporator including a refrigerant distribution assembly having an outer distributor and an inner distributor disposed within the outer distributor. Two-phase vapor-liquid refrigerant from a condenser first flows in the inner distributor. Vapor component of the two-phase refrigerant is discharged from the inner distributor into the outer distributor via a plurality of apertures formed in an upper portion of the inner distributor. A bottom portion of the inner distributor includes a plurality of openings through which the liquid component of the two-phase refrigerant is discharged into the outer distributor. The outer distributor has a plurality of apertures formed in lateral walls of the outer distributor to permit vapor refrigerant to flow from the outer distributor into a space within a hood enclosing the refrigerant distribution assembly. Liquid refrigerant collects in a bottom portion of the outer distributor and flows through distribution devices, such as nozzles, holes, openings, valves, etc., onto a tube bundle disposed below the refrigerant distribution assembly. Thus, with the refrigerant distribution assembly disclosed in this publication, vapor refrigerant is separated from liquid refrigerant, and only liquid refrigerant is discharged from the distribution devices toward the tube bundle.

U.S. Pat. No. 5,588,596 discloses a falling film evaporator including a vapor-liquid separator and a spray tree distribution system. The two-phase refrigerant from an expansion valve enters the vapor-liquid separator where the refrigerant is separated into vapor and liquid. The drain of the vapor-liquid separator is in fluid communication with and positioned above the spray tree distribution system which, in turn, is located above a tube bundle. The spray tree distribution system includes a manifold and a series of horizontal distribution tubes, each of which lies parallel to, in close proximity to, and directly above one uppermost tube of the tube bundle.

SUMMARY OF THE INVENTION

In a refrigerant distribution system that separates vapor refrigerant from liquid refrigerant and distributes only liquid refrigerant toward the tube bundle, a copious amount of refrigerant charge is required in order to ensure a sufficient flow of liquid refrigerant over the tube bundle so that all of the tubes remain wetted during operation. For example, in the refrigerant distribution assembly disclosed in U.S. Patent Application Publication No. 2009/0178790, levels (heights) of liquid refrigerant accumulated in both the inner distributor and the outer distributor are relatively high. Therefore, such a distribution system requires a relatively large amount of refrigerant charge. On the other hand, in the distribution system utilizing the spray tree distribution system disclosed in U.S. Pat. No. 5,588,596, the number and size of spray orifices formed in the distribution tubes need to be precisely controlled in view of a distribution flow amount and pressure loss due to the pipe length of the distribution tubes, and thus, structural complexity of the spray distribution system increases manufacturing cost. Moreover, the use of distribution tubes causes a higher pressure loss in the distribution system. Furthermore, distribution of the liquid refrigerant may become uneven due to reduced refrigerant flow rate when the evaporator operates under part-load condition.

More specifically, load of the vapor compression system fluctuates between, for example, 25% to 100%, and thus, the circulation amount of the refrigerant in the vapor compression system also fluctuates depending on operating conditions. In recent years, demand for better performance during part-load condition as well as during rated load condition has increased. With the flooded evaporator, performance of the evaporator can be maintained without significant degradation by controlling the liquid level within the evaporator shell even when the circulation amount of the refrigerant decreases under part-load condition. However, with the falling film evaporator, when the refrigerant distributed over the tube bundle decreases due to decrease in the circulation amount of the refrigerant, distribution of the refrigerant within the distributor system may become uneven, which could cause formation of dry patches in the tube bundle. Moreover, the evaporator may not be installed completely level, which could aggravate uneven distribution of the refrigerant over the tube bundle.

In view of the above, one object of the present invention is to provide a heat exchanger having a refrigerant distribution system that can reduce the amount of refrigerant charge while ensuring uniform distribution of the refrigerant over a heat transfer unit.

Another object of the present invention is to provide a heat exchanger having a refrigerant distribution system that promotes uniform distribution of the refrigerant over the heat transfer unit even when the evaporator is not completely level.

A heat exchanger according to one aspect of the present invention is adapted to be used in a vapor compression system, and includes a shell, a refrigerant distribution assembly and a heat transferring unit. The shell has a longitudinal center axis extending generally parallel to a horizontal plane. The refrigerant distribution assembly includes an inlet part, a first tray part, and a plurality of second tray parts. The inlet part is disposed inside of the shell and having at least one opening for discharging a refrigerant. The first tray part is disposed inside of the shell and continuously extending generally parallel to the longitudinal center axis of the shell to receive the refrigerant discharged from the opening of the inlet part. The first tray part has a plurality of first discharge apertures. The second tray parts are disposed inside of the shell below the first tray part to receive the refrigerant discharged from the first discharge apertures such that the refrigerant accumulated in the second tray parts does not communicate between the second tray parts. The second tray parts are aligned along a direction generally parallel to the longitudinal center axis of the shell, each of the second tray parts having a plurality of second discharge apertures. The heat transferring unit is disposed inside of the shell below the second tray parts so that the refrigerant discharged from the second discharge apertures of the second tray parts is supplied to the heat transferring unit.

A heat exchanger according to another aspect of the present invention is adapted to be used in a vapor compression system, and includes a shell, a refrigerant distribution assembly, and a heat transferring unit. The shell has a longitudinal center axis extending generally parallel to a horizontal plane. The refrigerant distribution assembly includes an inlet part, a first distribution part and a second distribution part. The inlet part discharges a refrigerant. The first distribution part accumulates the refrigerant discharged from the inlet part and for discharging the refrigerant downwardly. The second distribution part accumulates the refrigerant discharged from the first distribution part such that the refrigerant is divided into a plurality of portions that do not communicate with each other, and for discharging the refrigerant in each of the portions downwardly, a height of the refrigerant accumulated in the second distribution part being smaller than a height of the refrigerant accumulated in the first distribution part. The heat transferring unit performs heat transfer by using the refrigerant discharged from the second distribution part.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
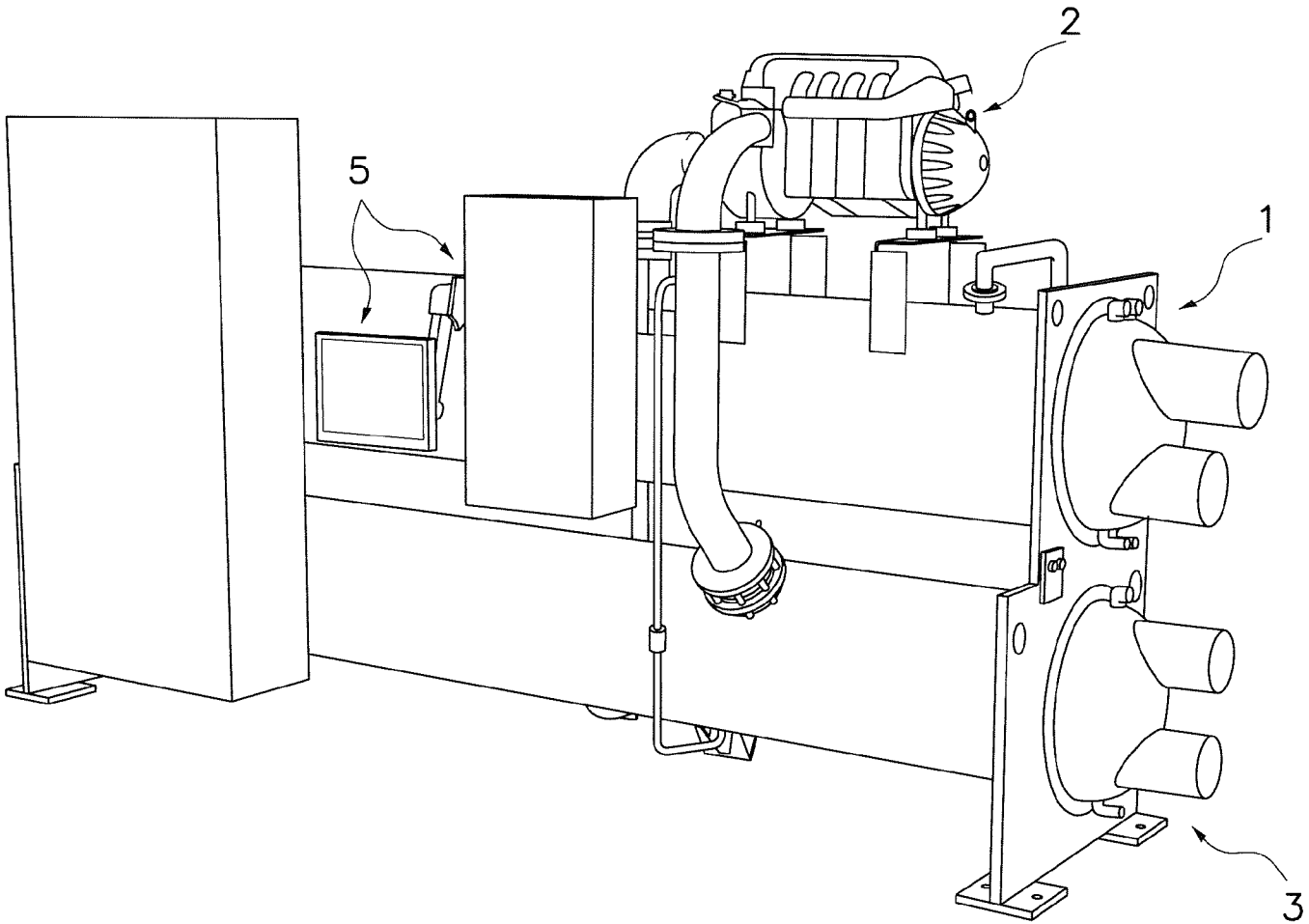
FIG. 1 is a simplified overall perspective view of a vapor compression system including a heat exchanger according to a first embodiment of the present invention.
Figure 2:
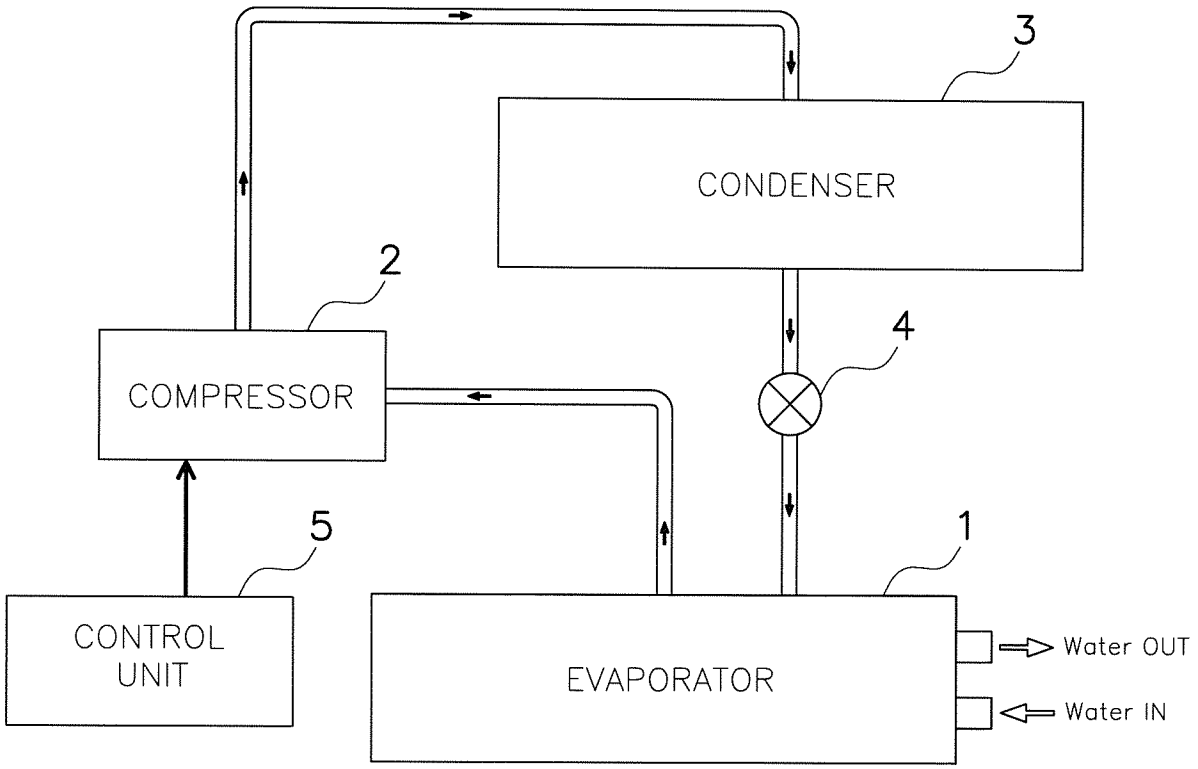
FIG. 2 is a block diagram illustrating a refrigeration circuit of the vapor compression system including the heat exchanger according to the first embodiment of the present invention.

Referring initially to FIGS. 1 and 2, a vapor compression system including a heat exchanger according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene, ethylene glycol, calcium chloride brine, etc.) via a vapor-compression refrigeration cycle.

As shown in FIGS. 1 and 2, the vapor compression system includes the following four main components: an evaporator 1, a compressor 2, a condenser 3 and an expansion device 4.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is in a two-phase gas/liquid state. The liquid refrigerant evaporates as the vapor refrigerant in the evaporator 1 while absorbing heat from the water.

The low pressure, low temperature vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger that removes heat from the vapor refrigerant causing it to condense from a gas state to a liquid state. The condenser 3 may be an air-cooled type, a water-cooled type, or any suitable type of condenser. The heat raises the temperature of cooling water or air passing through the condenser 3, and the heat is rejected to outside of the system as being carried by the cooling water or air.

The condensed liquid refrigerant then enters through the expansion device 4 where the refrigerant undergoes an abrupt reduction in pressure. The expansion device 4 may be as simple as an orifice plate or as complicated as an electronic modulating thermal expansion valve. The abrupt pressure reduction results in partial evaporation of the liquid refrigerant, and thus, the refrigerant entering the evaporator 1 is in a two-phase gas/liquid state.

Some examples of refrigerants used in the vapor compression system are hydrofluorocarbon (HFC) based refrigerants, for example, R-410A, R-407C, and R-134a, hydrofluoro olefin (HFO), unsaturated HFC based refrigerant, for example, R-1234ze, and R-1234yf, natural refrigerants, for example, R-717 and R-718, or any other suitable type of refrigerant.

The vapor compression system includes a control unit 5 that is operatively coupled to a drive mechanism of the compressor 2 to control operation of the vapor compression system.

It will be apparent to those skilled in the art from this disclosure that conventional compressor, condenser and expansion device may be used respectively as the compressor 2, the condenser 3 and the expansion device 4 in order to carry out the present invention. In other words, the compressor 2, the condenser 3 and the expansion device 4 are conventional components that are well known in the art. Since the compressor 2, the condenser 3 and the expansion device 4 are well known in the art, these structures will not be discussed or illustrated in detail herein. The vapor compression system may include a plurality of evaporators 1, compressors 2 and/or condensers 3.

Figure 3:
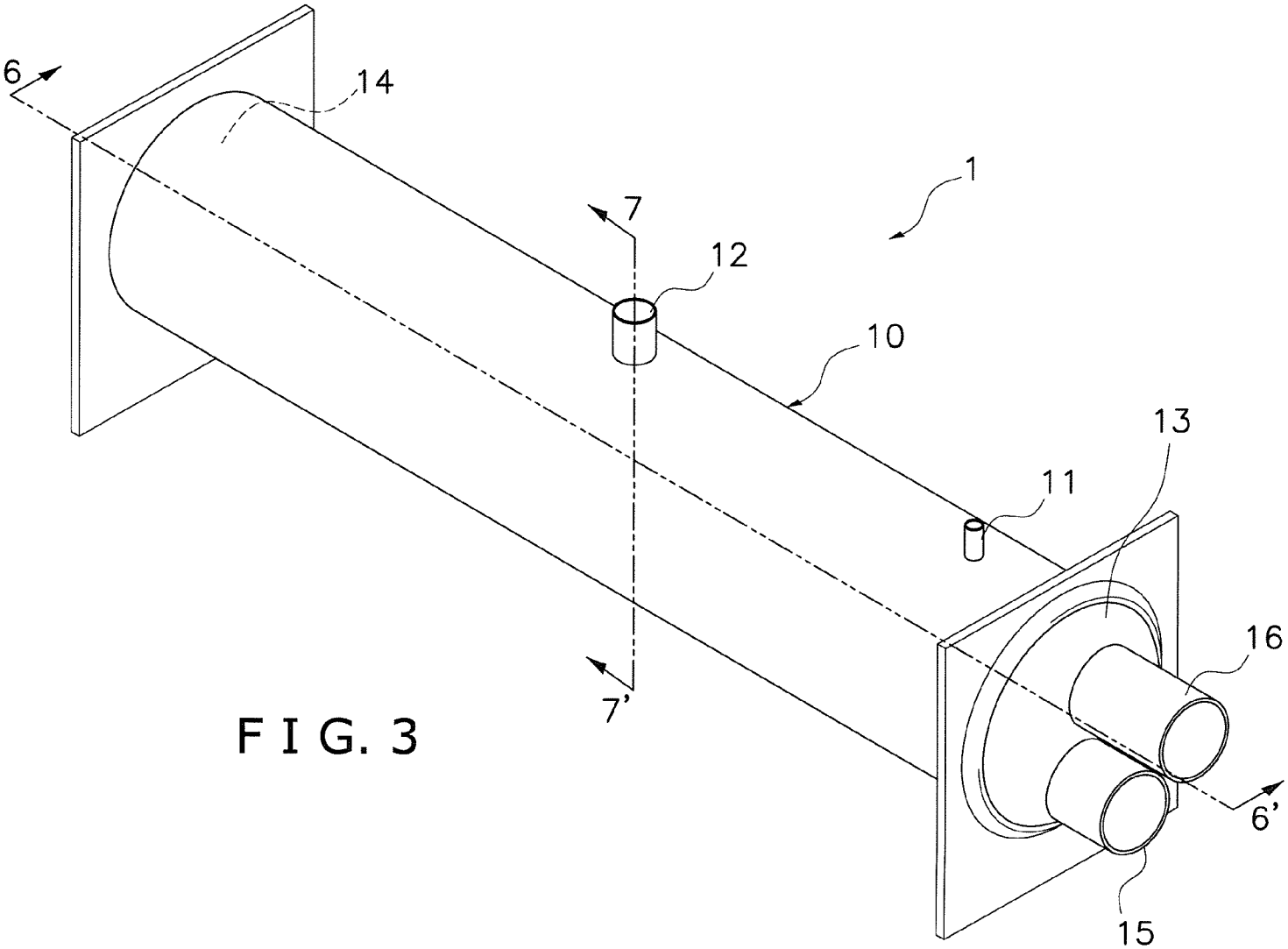
FIG. 3 is a simplified perspective view of the heat exchanger according to the first embodiment of the present invention.
Figure 4:
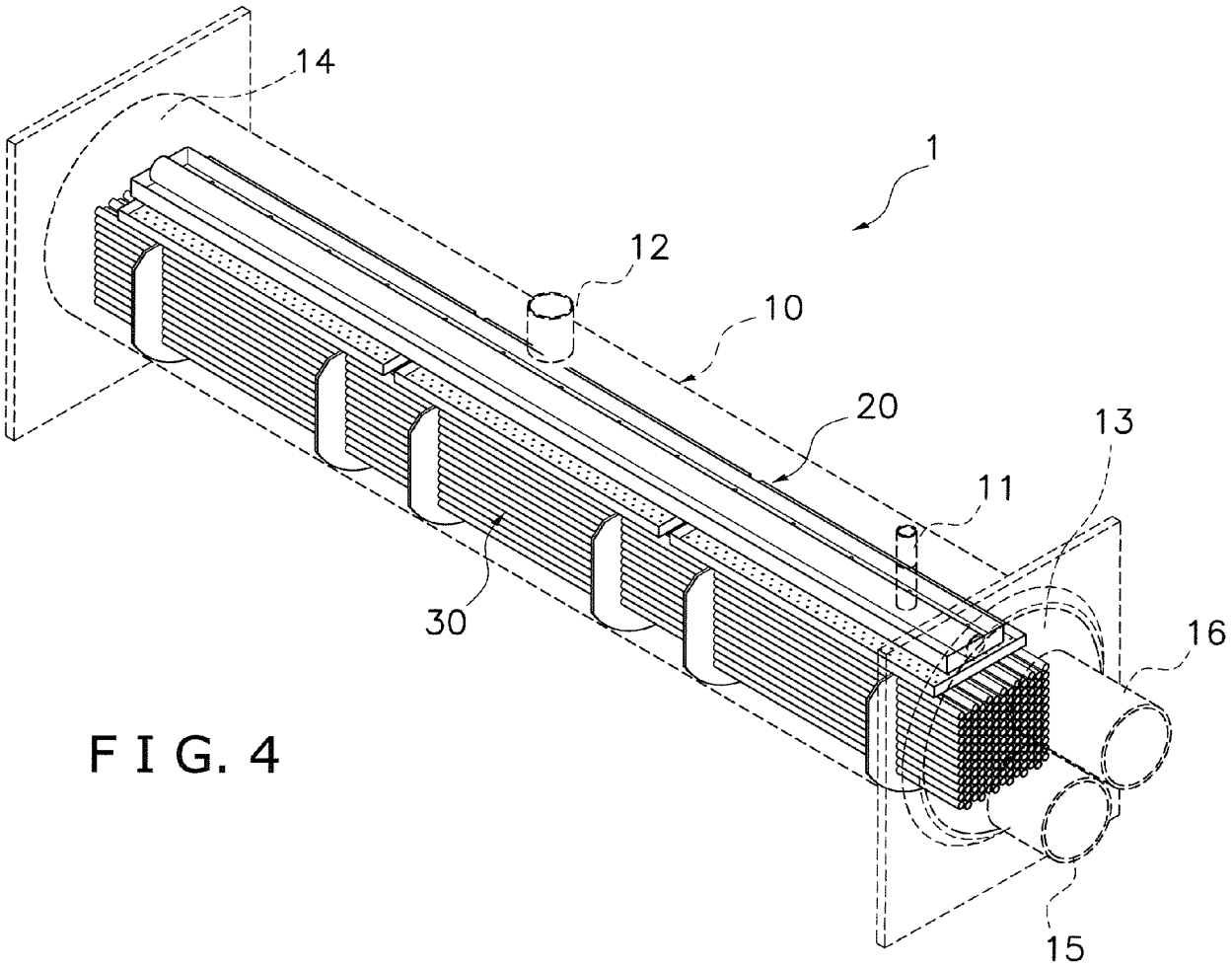
FIG. 4 is a simplified perspective view of an internal structure of the heat exchanger according to the first embodiment of the present invention.
Figure 5:
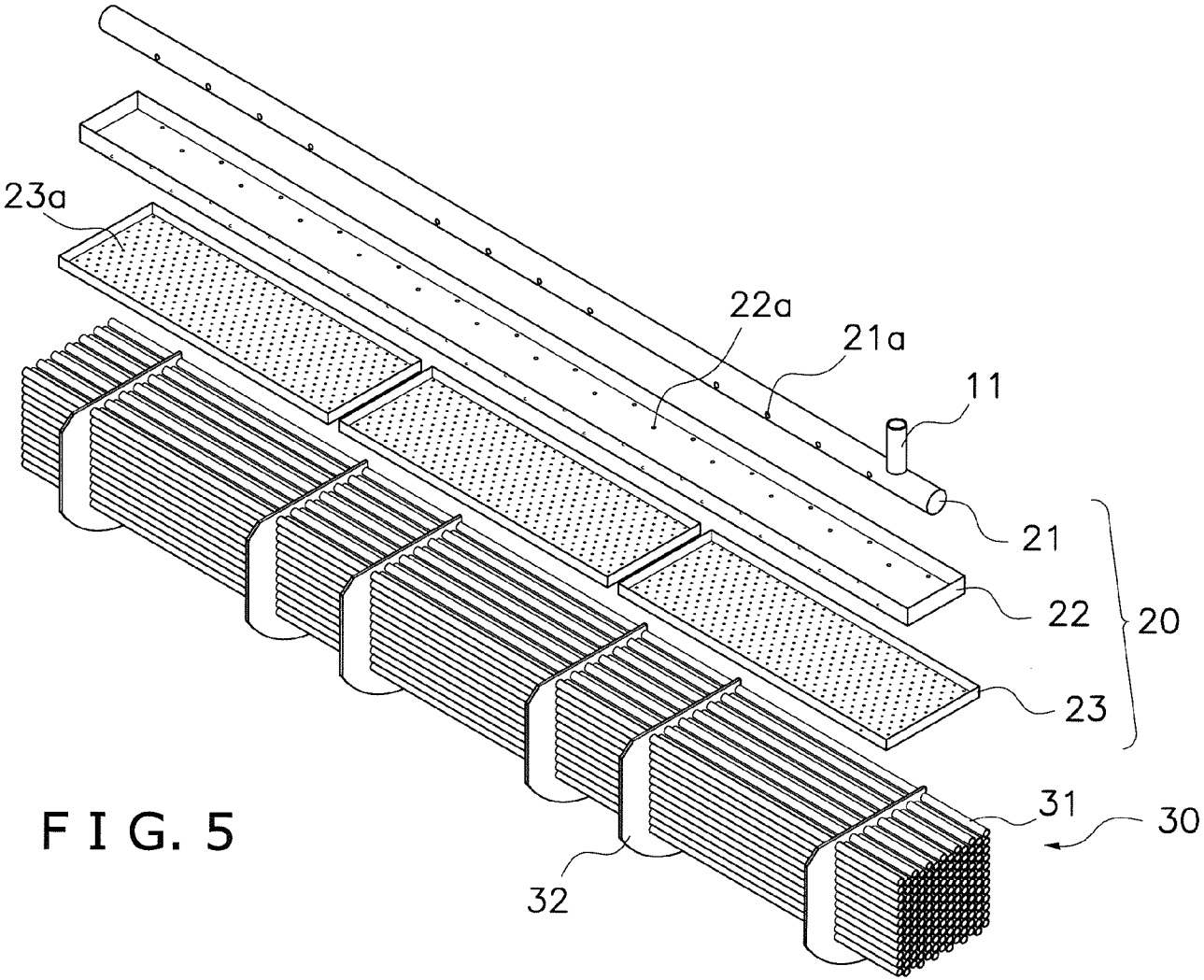
FIG. 5 is an exploded view of the internal structure of the heat exchanger according to the first embodiment of the present invention.
Figure 6:
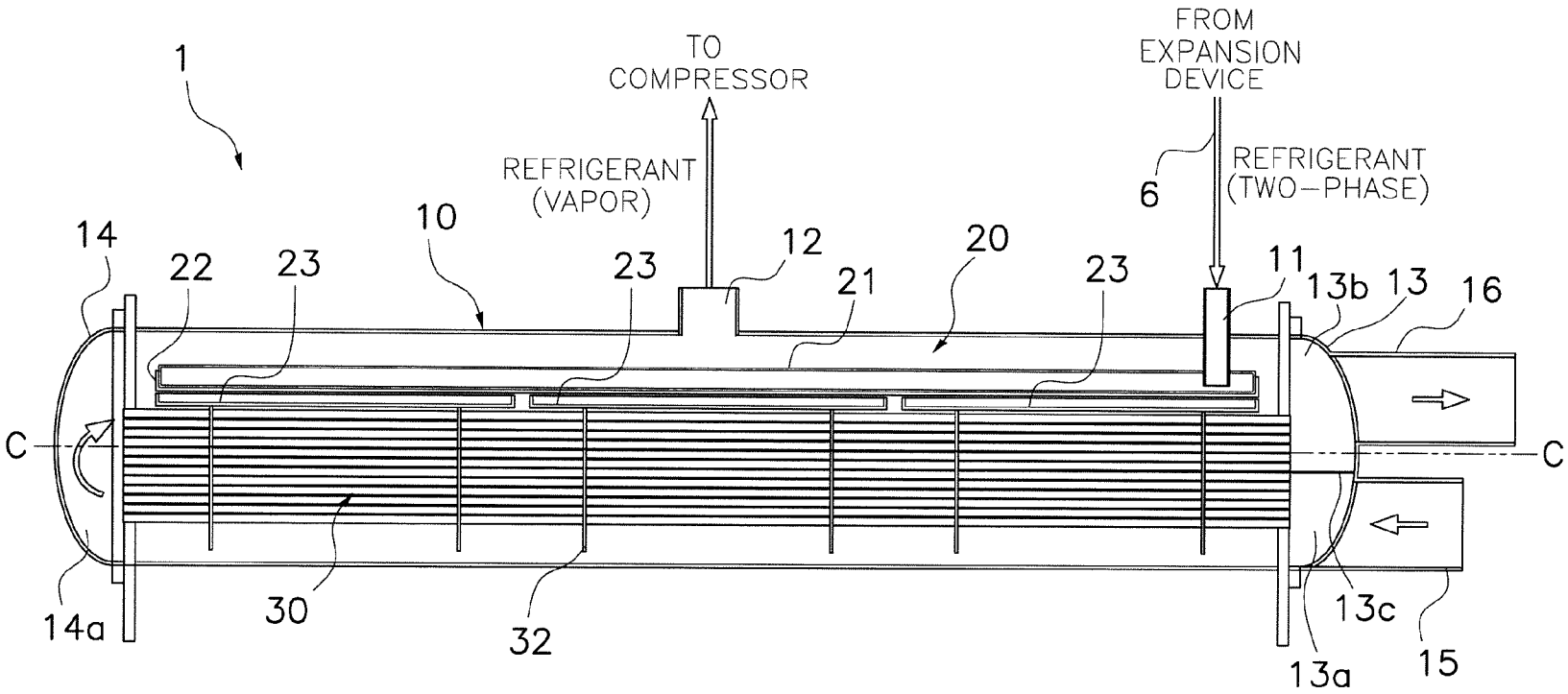
FIG. 6 is a simplified longitudinal cross sectional view of the heat exchanger according to the first embodiment of the present invention as taken along a section line 6-6' in FIG. 3.

Referring now to FIGS. 3 to 5, the detailed structure of the evaporator 1, which is the heat exchanger according to the first embodiment, will be explained. As shown in FIGS. 3 and 6, the evaporator 1 includes a shell 10 having a generally cylindrical shape with a longitudinal center axis C (FIG. 6) extending generally in the horizontal direction. The shell 10 includes a connection head member 13 defining an inlet water chamber 13*a* and an outlet water chamber 13*b*, and a return head member 14 defining a water chamber 14*a*. The connection head member 13 and the return head member 14 are fixedly coupled to longitudinal ends of a cylindrical body of the shell 10. The inlet water chamber 13*a* and the outlet water chamber 13*b* are partitioned by a water baffle 13*c*. The connection head member 13 includes a water inlet pipe 15 through which water enters the shell 10 and a water outlet pipe 16 through which the water is discharged from the shell 10. As shown in FIGS. 3 and 6, the shell 10 further includes a refrigerant inlet pipe 11 and a refrigerant outlet pipe 12. The refrigerant inlet pipe 11 is fluidly connected to the expansion device 4 via a supply conduit 6 (FIG. 7) to introduce the two-phase refrigerant into the shell 10. The expansion device 4 may be directly coupled at the refrigerant inlet pipe 11. The liquid component in the two-phase refrigerant boils and/or evaporates in the evaporator 1 and goes through phase change from liquid to vapor as it absorbs heat from the water passing through the evaporator 1. The vapor refrigerant is drawn from the refrigerant outlet pipe 12 to the compressor 2 by suction.

Figure 7:
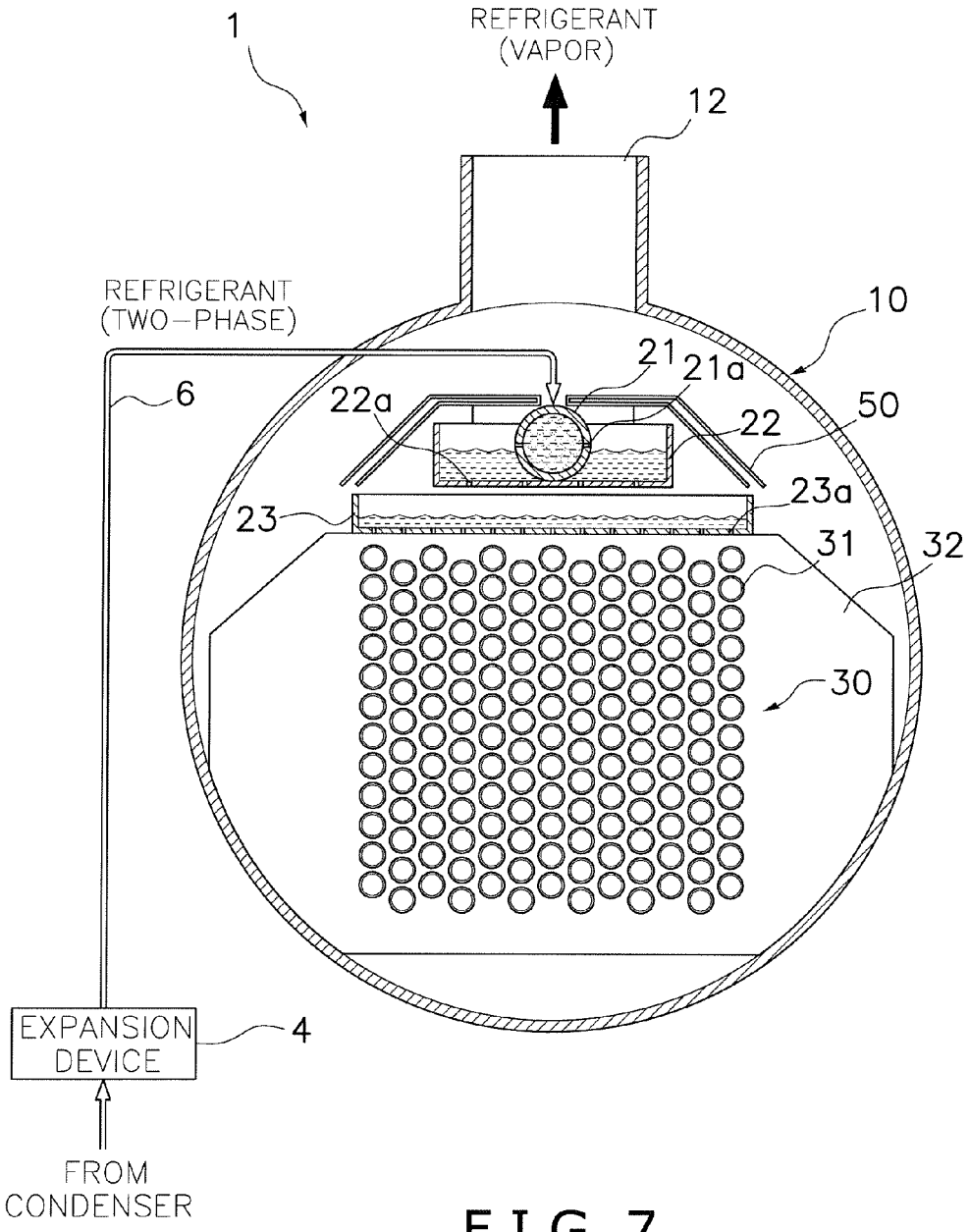
FIG. 7 is a simplified transverse cross sectional view of the heat exchanger according to the first embodiment of the present invention as taken along a section line 7-7' in FIG. 3.

FIG. 4 is a simplified perspective view illustrating an internal structure accommodated in the shell 10. FIG. 5 is an exploded view of the internal structure shown in FIG. 4. As shown in FIGS. 4 and 5, the evaporator 1 basically includes a refrigerant distribution assembly 20, a tube bundle 30, and a trough part 40. The evaporator 1 preferably further includes a baffle member 50 as shown in FIG. 7 although illustration of the baffle member 50 is omitted in FIGS. 4-6 for the sake of brevity.

The refrigerant distribution assembly 20 is configured and arranged to serve as both a gas-liquid separator and a refrigerant distributor. As shown in FIG. 5, the refrigerant distribution assembly 20 includes an inlet pipe part 21 (one example of an inlet part), a first tray part 22 and a plurality of second tray parts 23. The inlet pipe part 21, the first tray part 22 and the second tray parts 23 may be made of a variety of materials such as metal, alloy, resin, etc. In the first embodiment, the inlet pipe part 21, the first tray part 22 and the second tray parts 23 are made of metallic materials.

As shown in FIG. 6, the inlet pipe part 21 extends generally parallel to the longitudinal center axis C of the shell 10. The inlet pipe part 21 is fluidly connected to the refrigerant inlet pipe 11 of the shell 10 so that the two-phase refrigerant is introduced into the inlet pipe part 21 via the refrigerant inlet pipe 11. The inlet pipe part 21 includes a plurality of openings 21*a* disposed along the longitudinal length of the inlet pipe part 21 for discharging the two-phase refrigerant. When the two-phase refrigerant is discharged from the openings 21*a* of the inlet pipe part 21, the liquid component of the two-phase refrigerant discharged from the openings 21*a* of the inlet pipe part 21 is received by the first tray part 22. On the other hand, the vapor component of the two-phase refrigerant flows upwardly and impinges the baffle member 50 shown in FIG. 7, so that liquid droplets entrained in the vapor are captured by the baffle member 50. The liquid droplets captured by the baffle member 50 are guided along a slanted surface of the baffle member 50 toward the first tray part 22. The baffle member 50 may be configured as a plate member, a mesh screen, or the like. The vapor component flows downwardly along the baffle member 50 and then changes its direction upwardly toward the outlet pipe 12. The vapor refrigerant is discharged toward the compressor 2 via the outlet pipe 12.

As shown in FIGS. 5 and 6, the first tray part 22 extends generally parallel to the longitudinal center axis C of the shell 10. As shown in FIG. 7, a bottom surface of the first tray part 22 is disposed below the inlet pipe part 21 to receive the liquid refrigerant discharged from the openings 21*a* of the inlet pipe part 21. In the first embodiment, the inlet pipe part 21 is disposed within the first tray part 22 so that no vertical gap is formed between the bottom surface of the first tray part 22 and the inlet pipe part 21 as shown in FIG. 7. In other words, in the first embodiment, a majority of the inlet pipe part 21 overlaps the first tray part 22 when viewed along a horizontal direction perpendicular to the longitudinal center axis C of the shell 10 as shown in FIG. 6. This arrangement is advantageous because an overall volume of the liquid refrigerant accumulated in the first tray part 22 can be reduced while maintaining a level (height) of the liquid refrigerant accumulated in the first tray part 22 relatively high. Alternatively, the inlet pipe part 21 and the first tray part 22 may be arranged such that a larger vertical gap is formed between the bottom surface of the first tray part 22 and the inlet pipe part 21. The inlet pipe part 21, the first tray part 22 and the baffle member 50 are preferably coupled together and suspended from above in an upper portion of the shell 10 in a suitable manner.

Figure 8:
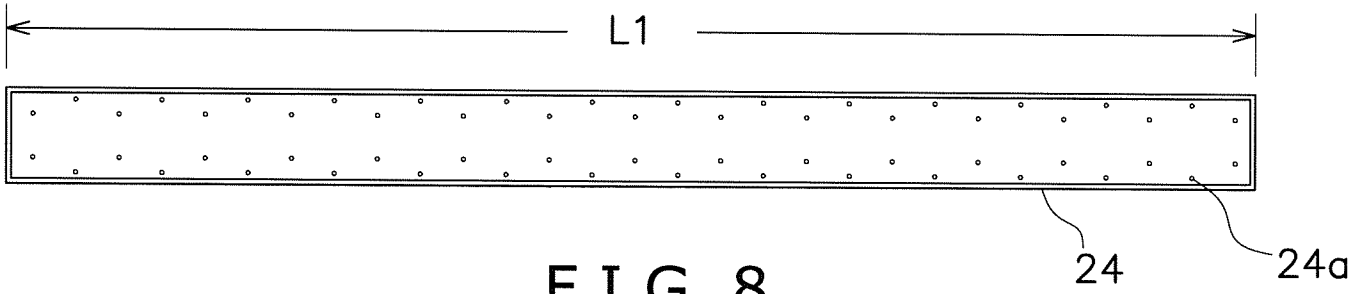
FIG. 8 is a top plan view of a first tray part of a refrigerant distribution assembly of the heat exchanger according to the first embodiment of the present invention.

As shown in FIG. 8, the first tray part 22 has a plurality of first discharge apertures 22*a* from which the liquid refrigerant accumulated therein is discharged downwardly. The liquid refrigerant discharged from the first discharge apertures 22*a* of the first tray part 22 is received by one of the second tray parts 23 disposed below the first tray part 22.

Figure 9:
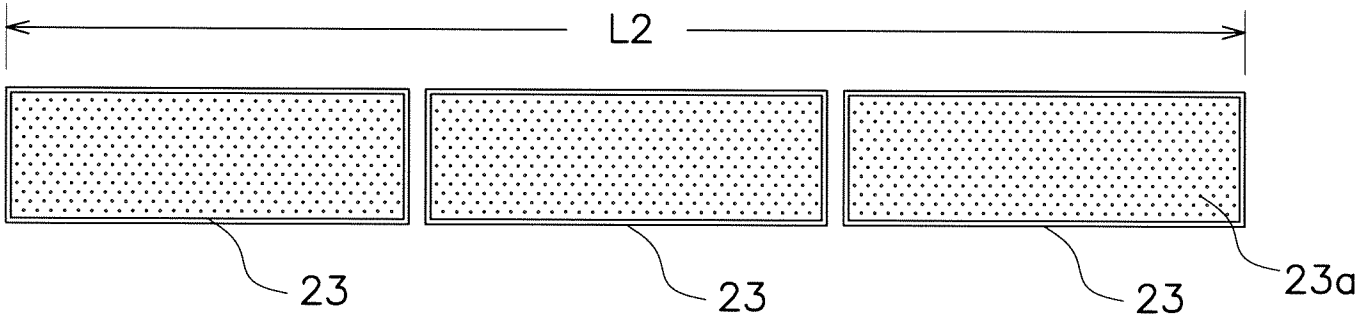
FIG. 9 is a top plan view of second tray parts of the refrigerant distribution assembly of the heat exchanger according to the first embodiment of the present invention.

As shown in FIGS. 5 and 9, the refrigerant distribution assembly 20 of the first embodiment includes three identical second try parts 23. The second tray parts 23 are aligned side-by-side along the longitudinal center axis C of the shell 10. As shown in FIGS. 8 and 9, an overall longitudinal length L2 of the three second tray parts 23 is substantially the same as a longitudinal length L1 of the first tray part 22 as shown in FIG. 6. A transverse width of the second tray part 23 is set to be larger than a transverse width of the first tray part 22 so that the second tray part 23 extends over substantially an entire width of the tube bundle 30 as shown in FIG. 7. The second tray parts 23 are arranged so that the liquid refrigerant accumulated in the second tray parts 23 does not communicate between the second tray parts 23. As shown in FIG. 9, each of the second tray parts 23 has a plurality of second discharge apertures 23*a* from which the liquid refrigerant is discharged downwardly toward the tube bundle 30. Each of the first discharge apertures 22*a* of the first tray part 22 is preferably sized larger than the second discharge apertures 23*a* of the second tray parts 23. In this way, the number of apertures to be formed in the first tray part 22 can be reduced, thereby reducing manufacturing cost.

In FIG. 7, the flow of refrigerant in the refrigeration circuit is schematically illustrated, and the inlet pipe 11 is omitted for the sake of brevity. The vapor component of the refrigerant supplied to the distributing part 20 is separated from the liquid component in the first tray section 22 of the distributing part 20 and exits the evaporator 1 through the outlet pipe 12. On the other hand, the liquid component of the two-phase refrigerant is accumulated in the first tray part 22 and then in the second tray parts 23, and discharged from the discharge apertures 23*a* of the second tray part 23 downwardly towards the tube bundle 30.

As shown in FIG. 7, the tube bundle 30 is disposed below the refrigerant distribution assembly 20 so that the liquid refrigerant discharged from the refrigerant distribution assembly 20 is supplied onto the tube bundle 30. The tube bundle 30 includes a plurality of heat transfer tubes 31 that extend generally parallel to the longitudinal center axis C of the shell 10 as shown in FIG. 6. The heat transfer tubes 31 are made of materials having high thermal conductivity, such as metal, and preferably provided with interior and exterior grooves to further promote heat exchange between the refrigerant and the water flowing inside the heat transfer tubes 31. Such heat transfer tubes including the interior and exterior grooves are well known in the art. For example, Thermoexel-E tubes by Hitachi Cable Ltd. may be used as the heat transfer tubes 31 of this embodiment. As shown in FIG. 5, the heat transfer tubes 31 are supported by a plurality of vertically extending support plates 32, which are fixedly coupled to the shell 10. The support plates 32 preferably also support the second tray parts 23 thereon. In the first embodiment, the tube bundle 30 is arranged to form a two-pass system, in which the heat transfer tubes 31 are divided into a supply line group disposed in a lower portion of the tube bundle 30, and a return line group disposed in an upper portion of the tube bundle 30. As shown in FIG. 6, inlet ends of the heat transfer tubes 31 in the supply line group are fluidly connected to the water inlet pipe 15 via the inlet water chamber 13*a* of the connection head member 13 so that water entering the evaporator 1 is distributed into the heat transfer tubes 31 in the supply line group. Outlet ends of the heat transfer tubes 31 in the supply line group and inlet ends of the heat transfer tubes 31 of the return line tubes are fluidly communicated with a water chamber 14*a* of the return head member 14. Therefore, the water flowing inside the heat transfer tubes 31 in the supply line group is discharged into the water chamber 14*a*, and redistributed into the heat transfer tubes 31 in the return line group. Outlet ends of the heat transfer tubes 31 in the return line group are fluidly communicated with the water outlet pipe 16 via the outlet water chamber 13*b* of the connection head member 13. Thus, the water flowing inside the heat transfer tubes 31 in the return line group exits the evaporator 1 through the water outlet pipe 16. In a typical two-pass evaporator, the temperature of the water entering at the water inlet pipe 15 may be about 54 degrees F. (about 12° C.), and the water is cooled to about 44 degrees F. (about 7° C.). when it exits from the water outlet pipe 16. Although, in this embodiment, the evaporator 1 is arranged to form a two-pass system in which the water goes in and out on the same side of the evaporator 1, it will be apparent to those skilled in the art from this disclosure that the other conventional system such as a one-pass or three-pass system may be used. Moreover, in the two-pass system, the return line group may be disposed below or side-by-side with the supply line group instead of the arrangement illustrated herein.

The heat transfer tubes 31 are configured and arranged to perform falling film evaporation of the liquid refrigerant. More specifically, the heat transfer tubes 31 are arranged such that the liquid refrigerant discharged from the refrigerant distribution assembly 20 forms a layer (or a film) along an exterior wall of each of the heat transfer tubes 31, where the liquid refrigerant evaporates as vapor refrigerant while it absorbs heat from the water flowing inside the heat transfer tubes 31. As shown in FIG. 7, the heat transfer tubes 31 are arranged in a plurality of vertical columns extending parallel to each other when seen in a direction parallel to the longitudinal center axis C of the shell 10 (as shown in FIG. 7). Therefore, the refrigerant falls downwardly from one heat transfer tube to another by force of gravity. The columns of the heat transfer tubes 31 are disposed with respect to the second discharge openings 23*a* of the second tray section 23 so that the liquid refrigerant discharged from the second discharge openings 23*a* is deposited onto an uppermost one of the heat transfer tubes 31 in each of the columns. In the first embodiment, the columns of the heat transfer tubes 31 are arranged in a staggered pattern as shown in FIG. 7. Moreover, in the first embodiment, a vertical pitch between two adjacent ones of the heat transfer tubes 31 is substantially constant. Likewise, a horizontal pitch between two adjacent ones of the columns of the heat transfer tubes 31 is substantially constant.

Referring now to FIGS. 10 to 15, the structures of the first tray part 22 and the second tray parts 23 of the refrigerant distribution assembly 20 according to the first embodiment will be explained in more detail.

In the first embodiment, the first tray part 22 and the second tray parts 23 are preferably arranged such that a height of the liquid refrigerant accumulated in the first tray part 22 is larger than a height of the liquid refrigerant accumulated in the second tray parts 23 when the evaporator 1 is in use. In other words, the size and number of the first discharge apertures 22*a* of the first tray part 22 and the second discharge apertures 23*a* of the second tray part 23 are adjusted to achieve the desired heights of the liquid refrigerant in the first tray part 22 and the second tray part 23. More specifically, a total cross-sectional area of the first discharge apertures 22*a* of the first tray part 22 and the a total cross-sectional area of the second discharge apertures 23*a* of the second tray part 23 are set so that the height of the liquid refrigerant accumulated in the first tray part 22 is larger than the height of the liquid refrigerant accumulated in the second tray parts 23 while maintaining the flow rate of the liquid refrigerant discharged from the first discharge apertures 22*a* and the flow rate of the liquid refrigerant discharged from the second discharge apertures 23*a* generally the same. Since the volume of the liquid refrigerant accumulated in the second tray parts 23 can be reduced according to the first embodiment, an overall charge of refrigerant can be reduced without degrading the heat transfer performance of the evaporator 1. Moreover, with the arrangement according to the first embodiment, even when the evaporator 1 is not completely level, the liquid refrigerant can be substantially evenly distributed from the refrigerant distribution assembly 20 onto the tube bundle 30 as described in more detail below.

One example of a method for determining the total cross-sectional area of the first discharge apertures 22*a* of the first tray part 22 and the total cross-sectional area of the second discharge apertures 23*a* of the second tray part 23 will be explained with reference to FIGS. 10 to 15.

When liquid in a container is discharged from an aperture formed in the container, a flow rate of the liquid discharged from the aperture is expressed by the following Equations (1) and (2).

$$Q=AV \quad \text{Equation (1)}$$

$$V=C\sqrt{2gh} \quad \text{Equation (2)}$$

In Equations (1) and (2), "Q" represents the flow rate of the liquid discharged from the aperture, "A" represents a cross-sectional area of the aperture, "V" represents a flow velocity of the liquid discharged from the aperture, "h" represents a height of the liquid in the container, and "C" represents a prescribed correction coefficient. Thus, the flow rate Q of the liquid discharged from the aperture is a function of the cross-sectional area A of the aperture and the height h of the liquid in the container.

Therefore, by adjusting the total cross-sectional area of the first discharge apertures 22*a* and the total-cross sectional area of the second discharge apertures 23*a*, the height of the liquid refrigerant in the first tray part 22 and the height of the liquid refrigerant in each of the second tray parts 23 can be adjusted while maintaining substantially the same discharge flow rate from the first tray part 22 and the second tray parts 23. In general, it is preferable to set the height of the liquid refrigerant in the first tray part 22 and the height of the liquid refrigerant in the second tray parts 23 to the smallest possible value that achieves the desired flow rate throughout the various operating conditions, thereby reducing the refrigerant charge as much as possible. Thus, if the evaporator 1 is installed on a completely level surface, and if distribution of the liquid refrigerant from the inlet pipe part 21 is substantially even, it is preferable to set each of the total cross-sectional area of the first discharge apertures 22*a* and the total-cross sectional area of the second discharge apertures 23*a* to the largest possible value for achieving the desired flow rate throughout the various operating conditions so that the height of the liquid refrigerant in the first tray part 22 and the height of the liquid refrigerant of the second tray part 23 are kept small.

Figure 10:
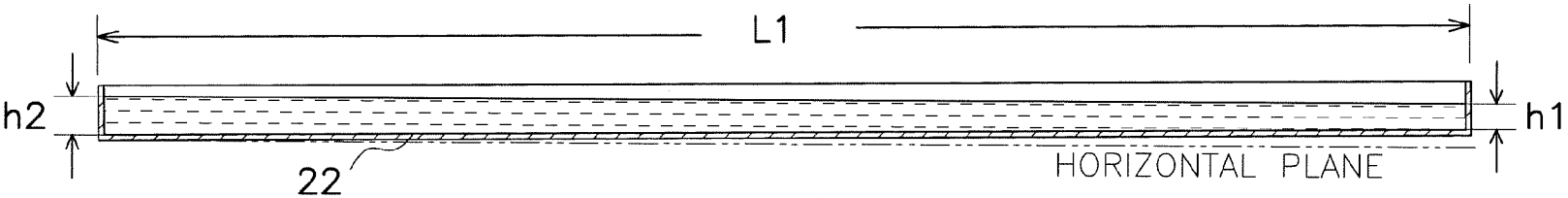
FIG. 10 is a longitudinal cross sectional view of the first tray part illustrating when the evaporator is not completely level according to the first embodiment of the present invention.

However, since the refrigerant entering into the inlet pipe part 21 is in a two-phase state, it is difficult to distribute the two-phase refrigerant evenly along the longitudinal direction from the inlet pipe part 21 to the first tray part 22. Moreover, it is very difficult to install the evaporator 1 completely level, and the longitudinal center axis C of the evaporator 1 may be slightly tilted with respect to the horizontal plane. When the evaporator 1 is slightly tilted, a height difference is created between the longitudinal ends of the evaporator 1. For example, if the evaporator 1 has an overall longitudinal length of about 3 meters, and is installed such that the longitudinal center axis C is inclined with respect to the horizontal plane at an inclination of 3/1000 rad (which is usually the maximum allowable inclination for installation), a height difference between the longitudinal ends of the evaporator is about 9 mm. In such a case, as shown in FIG. 10, a difference between a height h1 of the liquid refrigerant on one side of the first tray part 22 and a height h2 on the other side of the first tray part 22 is also about 9 mm. Since the flow rate of the liquid refrigerant from the first tray section 22 is a function of the height of the liquid refrigerant accumulated in the first tray part 22 as described in the Equations (1) and (2), such a difference between the heights h1 and h2 of the liquid refrigerant within the first tray part 22 causes variation in the discharge flow rate of the liquid refrigerant from one area of the first tray part 22 to another. In such a case, distribution of the liquid refrigerant from the first tray part 22 will become uneven, and there will be a higher risk of formation of dry patches in the tube bundle 30. Accordingly, in the first embodiment, the total cross-cross sectional area of the first discharge apertures 22*a* of the first tray part 22 is determined so that the liquid refrigerant is distributed substantially evenly toward the second tray parts 23 even when the evaporator 1 is installed on a slightly slanted surface.

Figure 11:
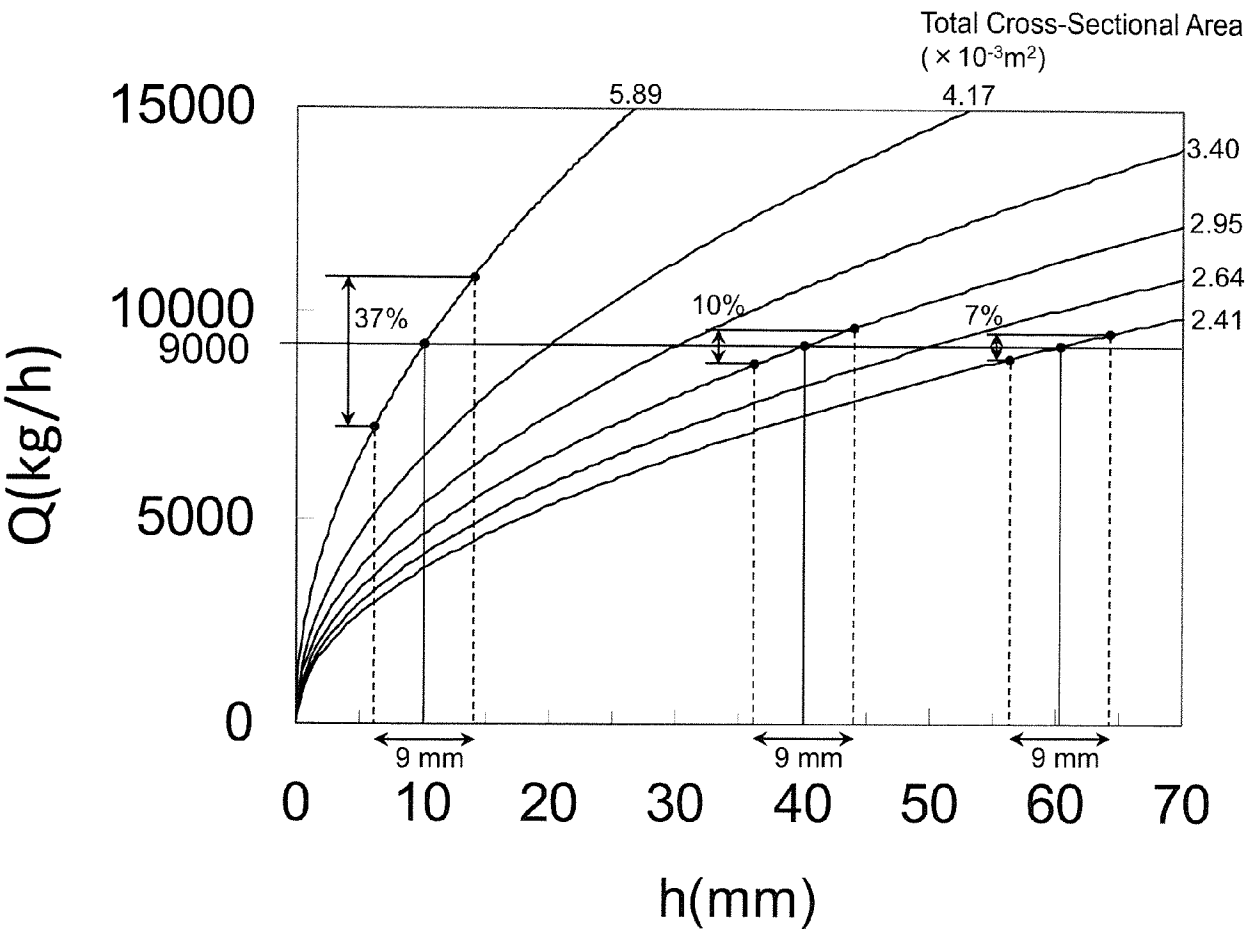
FIG. 11 is a graph of the height of the liquid refrigerant accumulated in the first tray part and the flow rate of the liquid refrigerant discharged from the first tray part with various total cross-sectional areas of first discharge apertures according to the first embodiment of the present invention.

FIG. 11 shows graphs of the flow rate Q (kg/h) of the liquid refrigerant from the first discharge apertures 22*a* and the height h (mm) of the liquid refrigerant in the first tray part 22 with various total cross-sectional areas of the first discharge apertures 22*a*. In this example, the evaporator 1 has a capacity of 150 ton with a maximum flow rate of 9000 kg/h, and the longitudinal length of the evaporator 1 is about 3 meters. As shown in FIG. 11, the height h of the liquid refrigerant in the first tray part 22 for achieving a certain flow rate Q becomes larger as the total cross-sectional area becomes smaller. For example, in order to achieve the flow rate of about 9000 kg/h, the height h of the liquid refrigerant in the first tray part 22 is about 10 mm when the total cross-sectional area of the first discharge apertures 22*a* is $5.89\times10^{-3}$ m$^2$, about 40 mm when the total cross-sectional area of the first discharge apertures 22*a* is $2.95\times10^{-3}$ m$^2$, and about 60 mm when the total cross-sectional area of the first discharge apertures 22*a* is $2.41\times10^{-3}$ m$^2$. In general, it is preferable to set the total cross-sectional area of the first discharge apertures 22*a* of the first tray part 22 to a larger value so that the height of the liquid refrigerant in the first tray part 22 is kept small.

However, when there is a height difference in the liquid refrigerant accumulated in the first tray part 22 due to inclination of the evaporator 1 as shown in FIG. 10 or due to uneven distribution of the refrigerant from the inlet pipe part 21, the flow rate Q also varies from a value corresponding to the height h1 on one side and to a value corresponding to the height h2 on the other side of the first tray part 22. Assuming that there is a 9 mm height difference in the liquid refrigerant accumulated in the first tray part 22 from one side to the other and the average height h of the liquid refrigerant is 40 mm, the height of the liquid refrigerant varies from 35.5 mm (h1) on one side to 44.5 mm (h2) on the other side. Thus, when the total cross-sectional area of the first discharge apertures 22*a* is $2.95\times10^{-3}$m$^2$, variation between the flow rate Q corresponding to the height h1 and the flow rate Q corresponding to the height h2 is about 10% as shown in FIG. 11. This variation in the flow rate Q is much larger when the height h is smaller. For example, when the total cross-sectional area of the first discharge apertures 22*a* is $5.89\times10^{-3}$m$^2$ and the average height of the liquid refrigerant is about 10 mm, variation between the flow rate Q corresponding to the height h1 and the flow rate Q corresponding to the height h2 is about 37%. Such large variation in the flow rate Q will cause uneven distribution of the liquid refrigerant from the first tray part 22. On the other hand, when the total cross-sectional area of the first discharge apertures 22*a* is $2.41\times10^{-3}$m$^2$, variation in the flow rate Q is smaller at about 7%. However, in such a case, the height of the liquid refrigerant required to achieve the flow rate of 9000 kg/h is larger, which causes undesirable increase in the amount of refrigerant charge.

Accordingly, the total cross-sectional area of the first discharge apertures 22*a* is preferably set to strike a balance between suppressing the variation in the flow rate Q and keeping the height h of the liquid refrigerant as small as possible. In the first embodiment of the present invention, the total cross-sectional area of the first discharge apertures 22*a* is set so that the variation in the flow rate Q does not exceed more than 10% when there is a height difference in the liquid refrigerant accumulated in the first tray part 22, while the average height of the liquid refrigerant is kept as small as possible. It will be apparent to those skilled in the art from this disclosure that the optimal total cross-sectional area of the first discharge apertures 22*a* varies according to the size and capacity (i.e., maximum flow rate) of the individual evaporator. For instance, in the example shown in FIG. 11 for the evaporator 1 that has a capacity of 150 ton with a maximum flow rate of 9000 kg/h and a longitudinal length of about 3 meters, the total cross-sectional area of the first discharge apertures 22*a* is preferably set to about $2.95\times10^{-3}m^2$. In such a case, the average height h of the liquid refrigerant accumulated in the first tray part 22 is about 40 mm when the evaporator 1 is in use.

Figure 12:
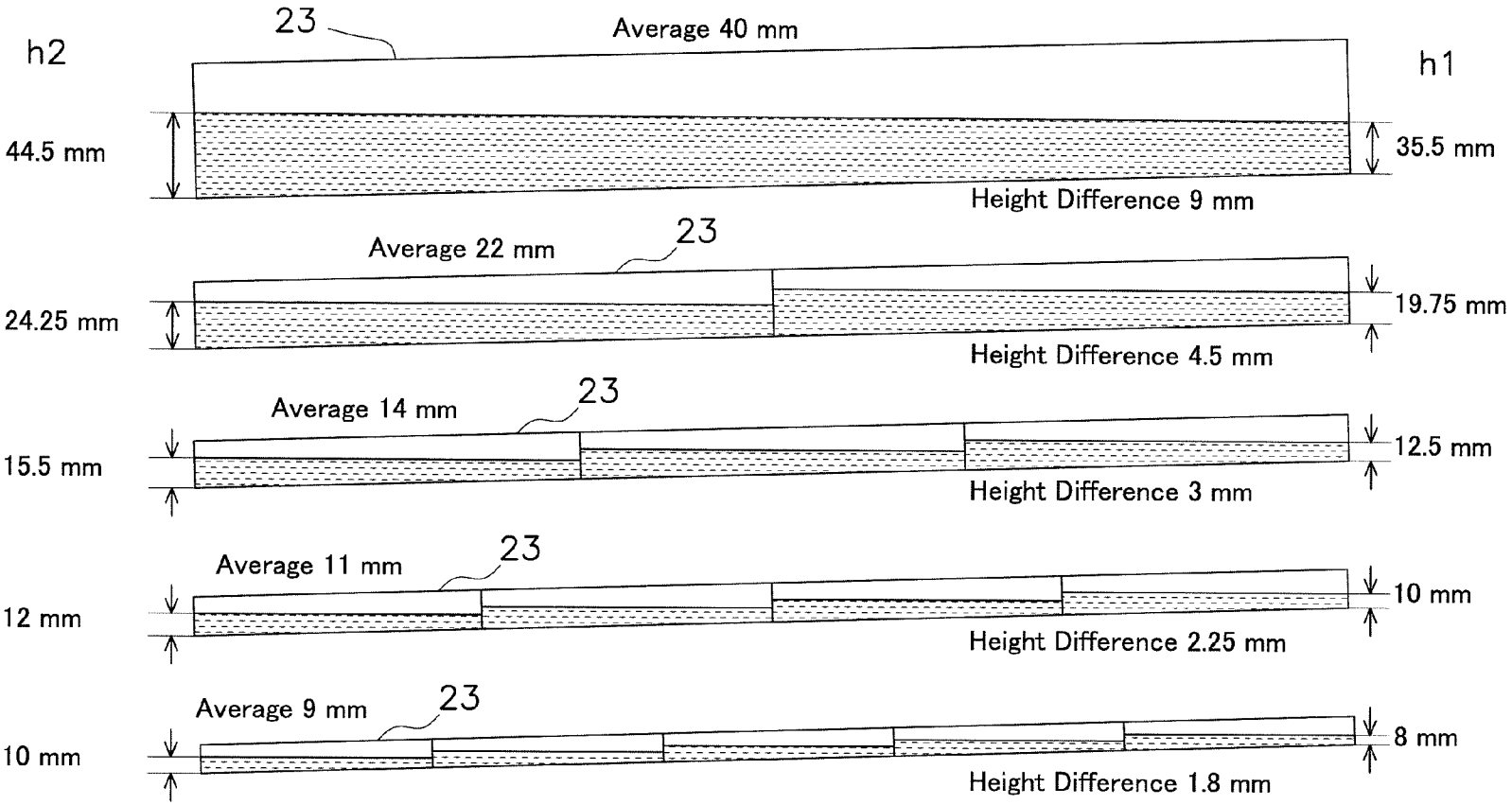
FIG. 12 is a schematic illustration for explaining changes in height of the liquid refrigerant accumulated in each of the second tray parts as the number of the second tray parts changes according to the first embodiment of the present invention.

The same principle as explained above applies when determining the total cross-sectional area of the second apertures 23*a* of the second tray part 23. However, since the longitudinal length of each of the second tray parts 23 is shorter than the first tray part 22, a height difference in the liquid refrigerant accumulated in each of the second tray parts 23 from one side to the other is smaller than that of the first tray part 22. Therefore, the height of the liquid refrigerant accumulated in each of the second tray parts 23 can be kept smaller than that of the first tray part 22. FIG. 12 is a schematic illustration for explaining this concept. If there is only one second tray part 23 having the same longitudinal length as the first tray part 22, the total cross-sectional area of the second discharge apertures 23*a* is set so that the average height is about 40 mm, and the height h1 on one side is 35.5 mm and the height h2 on the other side is 44.5 mm when a 9 mm height difference exits in the liquid refrigerant accumulated in the second tray part 23 as explained above. However, when there are provided two second tray parts 23 with each of the second tray parts 23 having a longitudinal length that is about one half of the longitudinal length of the first tray part 22, a height difference in the liquid refrigerant accumulated in each of the second tray parts 23 from one side to the other is reduced to 4.5 mm. In such a case, variation in the flow rate Q of the liquid refrigerant discharged from each of the second tray parts 23 due to the height difference is also reduced. Therefore, the total cross-sectional area of the second discharge apertures 23*a* can be made larger to reduce the height of the liquid refrigerant in the second tray parts 23 while keeping the variation in the flow rate at about 10%. For example, when there are two second tray parts 23, the total cross-sectional area of the second discharge apertures 23*a* can be enlarged so that an average height of the liquid refrigerant in each of the second tray sections 23 is about 22 mm as shown in FIG. 12, while maintaining the variation in the flow rate Q at about 10%.

Similarly, when there are provided three second tray parts 23 with each of the second tray parts 23 having a longitudinal length that is about one-third of the longitudinal length of the first tray part 22, a height difference in the liquid refrigerant accumulated in each of the second tray parts 23 from one side to the other is reduced to 3 mm. Therefore, the total cross-sectional area of the second discharge apertures 23*a* can be further enlarged so that an average height of the liquid refrigerant in each of the second tray sections 23 is about 14 mm, while maintaining the variation in the flow rate Q at about 10%. When there are provided four second tray parts 23 with each of the second tray parts 23 having a longitudinal length that is about one quarter of the longitudinal length of the first tray part 22, a height difference in the liquid refrigerant accumulated in each of the second tray parts 23 from one side to the other is reduced to 2.25 mm. Therefore, the total cross-sectional area of the second discharge apertures 23*a* can be further enlarged so that an average height of the liquid refrigerant in each of the second tray sections 23 is about 11 mm, while maintaining the variation in the flow rate Q at about 10%. When there are provided five second tray parts 23 with each of the second tray parts 23 having a longitudinal length that is about one-fifth of the longitudinal length of the first tray part 22, a height difference in the liquid refrigerant accumulated in each of the second tray parts 23 from one side to the other is reduced to 3 mm. Therefore, the total cross-sectional area of the second discharge apertures 23*a* can be enlarged so that an average height of the liquid refrigerant in each of the second tray sections 23 is about 9 mm, while maintaining the variation in the flow rate Q at about 10%.

Figure 13:
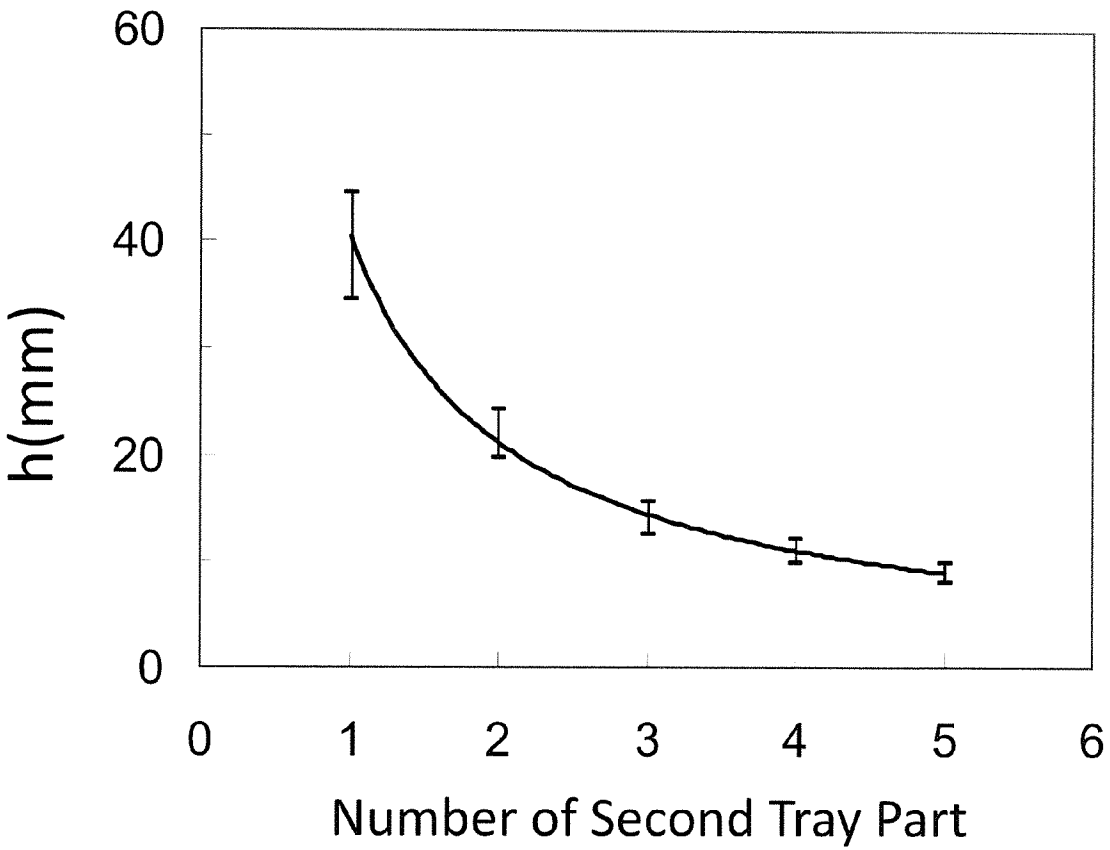
FIG. 13 is a graph of the number of the second tray parts and the height of the liquid refrigerant accumulated in each of the second tray parts.

FIG. 13 is a graph of the height h of the liquid refrigerant in each of the second tray parts 23 and the number of the second tray parts 23 as shown in FIG. 12. As shown in FIG. 13, the height of the liquid refrigerant accumulated in each of the second tray parts 23 can be made smaller as the number of the second tray parts 23 increases, and thus, as the longitudinal length of each the second tray parts 23 decreases. The height of the liquid refrigerant in each of the second tray parts 23 becomes drastically smaller when the number of the second tray parts 23 is equal to or greater than three. Thus, in the first embodiment, it is preferable to provide three or more second tray parts 23 in the evaporator 1. However, it will be apparent to those skilled in the art from this disclosure that the optimal number of the second tray parts 23 varies depending on the actual size and capacity of the evaporator 1.

Figure 14:
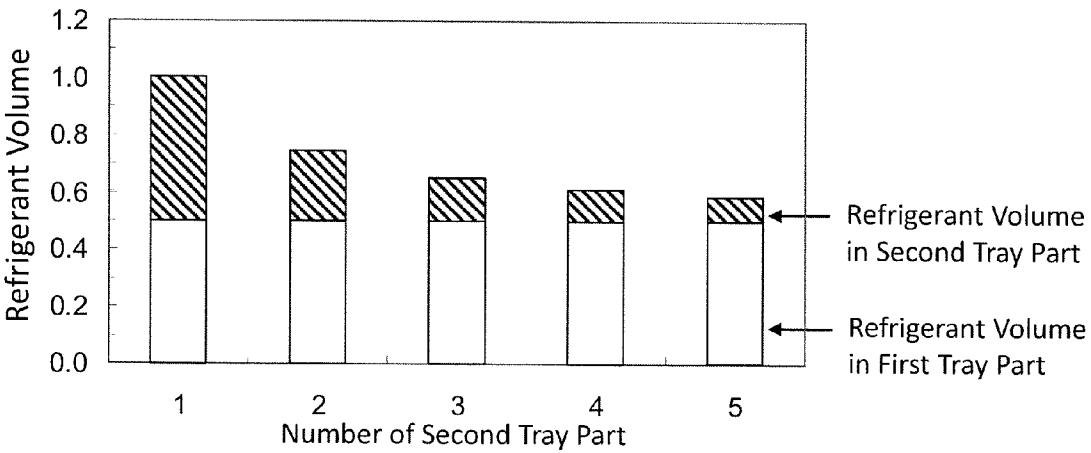
FIG. 14 is a graph of the number of the second tray parts and volumes of liquid refrigerant accumulated in the first tray part and each of the second tray parts according to the first embodiment of the present invention.
Figure 15:
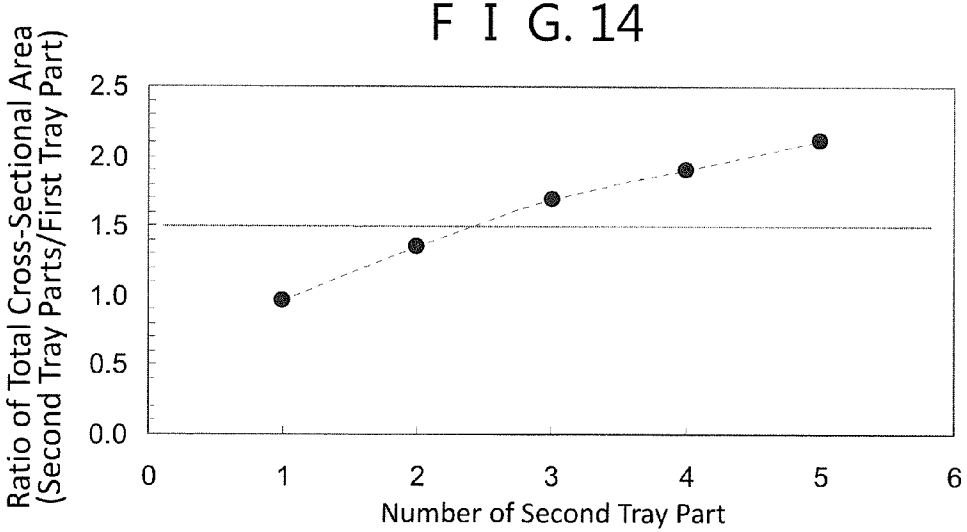
FIG. 15 is a graph of the number of second tray parts and the ratio of the total cross-sectional area of the second discharge apertures to the total cross-sectional area of the first discharge apertures according to the first embodiment of the present invention.

FIG. 14 shows a graph of the accumulated volume of the refrigerant in the first tray part 22 and the second tray part 23 and the number of the second tray parts 23. FIG. 15 shows a graph of a ratio between the total cross-sectional area of the first discharge apertures 22*a* and the second discharge apertures 23*a* and the number of the second tray parts 23.

As shown in FIG. 14, the accumulated volume of the liquid refrigerant in the second tray part 23 decreases as the number of the second tray parts 23 increases because the height of the accumulated liquid refrigerant decreases as shown in FIG. 13. Moreover, the total cross-sectional area of the second apertures 23*a* can be increased while maintaining the variation in the flow rate at about 10% when the number of the second tray parts 23 increases as explained above. Therefore, as shown in FIG. 15, the ratio of the total cross-sectional area of the second discharge apertures 23*a* to the total cross-sectional area of the first discharge apertures 22*a* increases as the number of the second tray parts 23 increases. As shown in FIGS. 14 and 15, the accumulated volume of the liquid refrigerant in the second tray part 23 becomes smaller when the ratio of the total cross-sectional area of the second discharge apertures 23*a* to the total cross-sectional area of the first discharge apertures 22*a* is equal to or greater than 1.2. Therefore, in the first embodiment, the first tray part 22 and the second tray part 23 are preferably arranged so that the ratio of the total cross-sectional area of the second discharge apertures 23*a* to the total cross-sectional area of the first discharge apertures 22*a* is equal to or greater than 1.2, or more preferably, equal to or greater than 1.5.

Accordingly, with the refrigerant distribution assembly 20 according to the first embodiment, even when distribution of the two-phase refrigerant from the inlet pipe part 21 to the first tray part 22 is not uniform, the liquid refrigerant is accumulated in the first tray part 22, which continuously extends in the longitudinal direction. Therefore, unevenness in the distribution of the liquid refrigerant from the inlet pipe part 21 is mitigated by the first tray part 22. Moreover, since a relatively large amount of the liquid refrigerant is accumulated in the first tray part 22, variation in the flow rate of the liquid refrigerant discharged from the first tray part 22 can be suppressed even when the evaporator 1 is not level. Furthermore, since a plurality of the second tray parts 23 are provided, the height of the liquid refrigerant accumulated in each of the second tray parts 23 can be reduced while maintaining the variation in the flow rate of the liquid refrigerant from the second tray parts 23 at or below a prescribed level (e.g., 10%). Accordingly, the refrigerant charge can be reduced while ensuring good heat transfer performance. Furthermore, the pressure loss in the refrigerant distribution assembly 20 can be reduced by using the first tray section 22 and the second tray sections 23 instead of pipes or tubes for distributing the liquid refrigerant.

Figure 16:
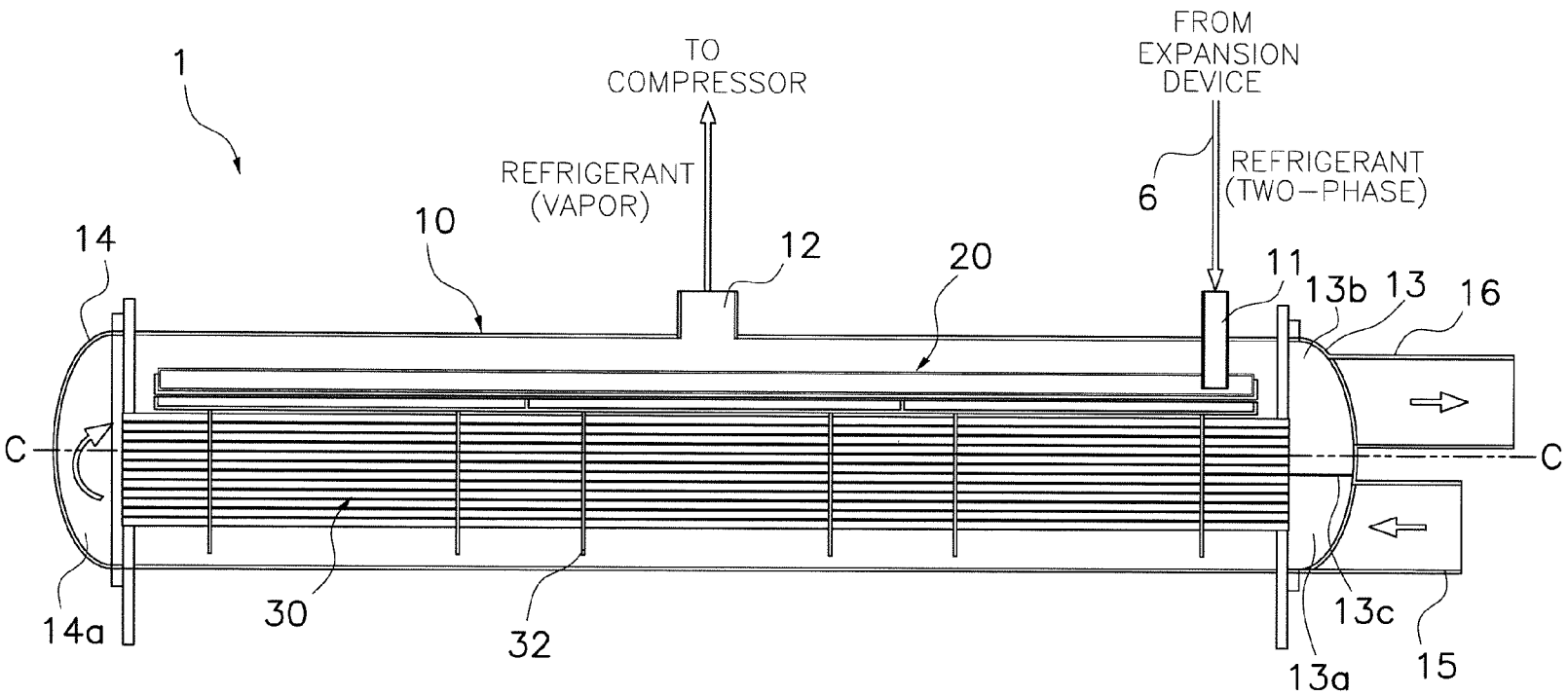
FIG. 16 is a simplified longitudinal cross sectional view of the heat exchanger illustrating a modified example of an arrangement of the second tray parts according to the first embodiment of the present invention.
Figure 17:
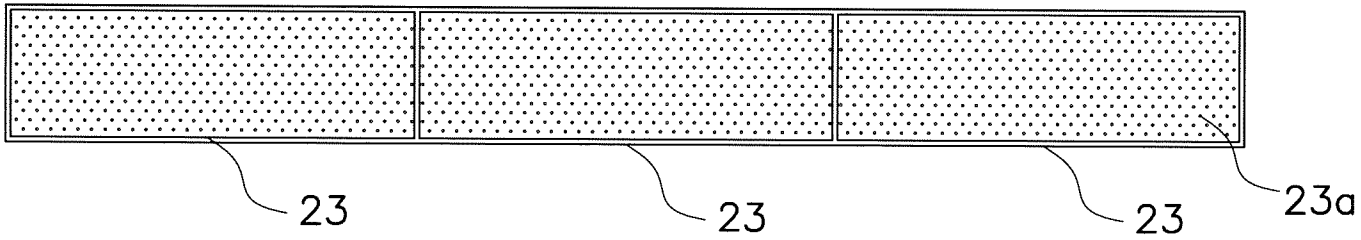
FIG. 17 is a top plan view of the second tray parts of the modified example shown in FIG. 16 according to the first embodiment of the present invention.

In the above described embodiment, the second tray parts 23 are arranged as separate bodies that are spaced apart from each other. A longitudinal distance between the second tray parts 23 is set to be small enough so as not to form a gap in continuous distribution of the liquid refrigerant with respect to the longitudinal direction. Alternatively, the second tray parts 23 may be formed integrally as shown in FIGS. 16 and 17. In this case too, the second tray parts 23 are arranged so that the liquid refrigerant accumulated in the second tray parts 23 does not communicate between the second tray parts 23.

Moreover, in the first embodiment, the first discharge apertures 22*a* and the second discharge apertures 23*a* are illustrated as circular holes. However, the shape and configuration of the first discharge apertures 22*a* and the second discharge apertures 23*a* are not limited to a simple circular hole, and any suitable opening may be utilized as the first discharge apertures 22*a* and the second discharge apertures 23*a*.

Figure 18:
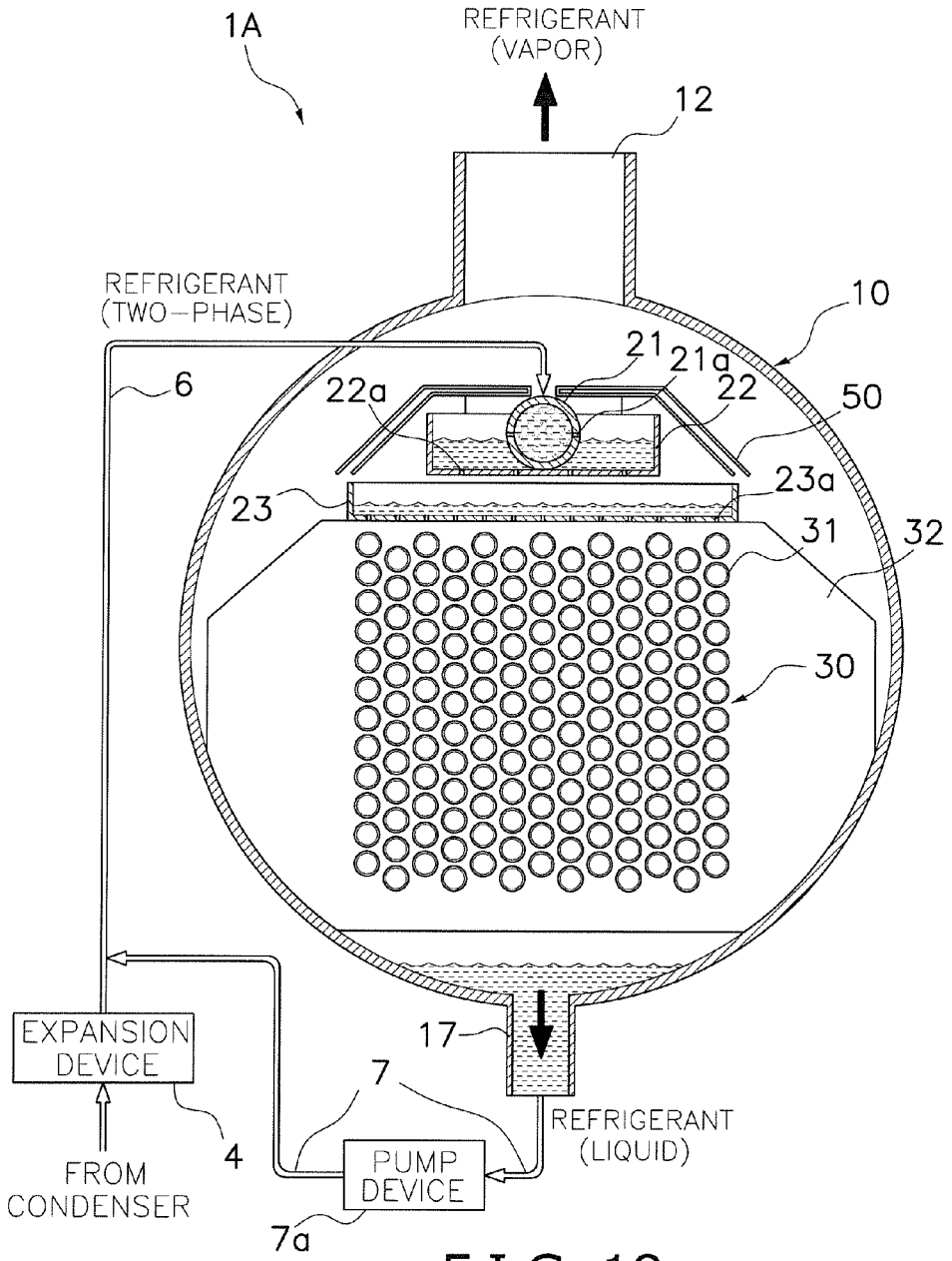
FIG. 18 is a simplified transverse cross sectional view of the heat exchanger illustrating a modified example in which the heat exchanger is provided with a refrigerant recirculation system according to the first embodiment of the present invention.

An evaporator 1A according to a modified example of the first embodiment may be provided with a refrigerant recirculation system. More specifically, as shown in FIG. 18, the shell 10 may include a bottom outlet pipe 17 in fluid communication with a conduit 7 that is coupled to a pump device 7*a*. The pump device 7*a* is selectively operated so that the liquid refrigerant accumulated in the bottom portion of the shell 10 recirculates back to the distribution part 20 of the evaporator 10 via the inlet pipe 11 (FIG. 1). The bottom outlet pipe 16 may be placed at any longitudinal position of the shell 110. Alternatively, the pump device 7*a* may be replaced by an ejector device which operates on Bernoulli's principal to draw the liquid refrigerant accumulated in the bottom portion of the shell 10 using the pressurized refrigerant from the condenser 2. Such an ejector device combines the functions of an expansion device and a pump.

Figure 19:
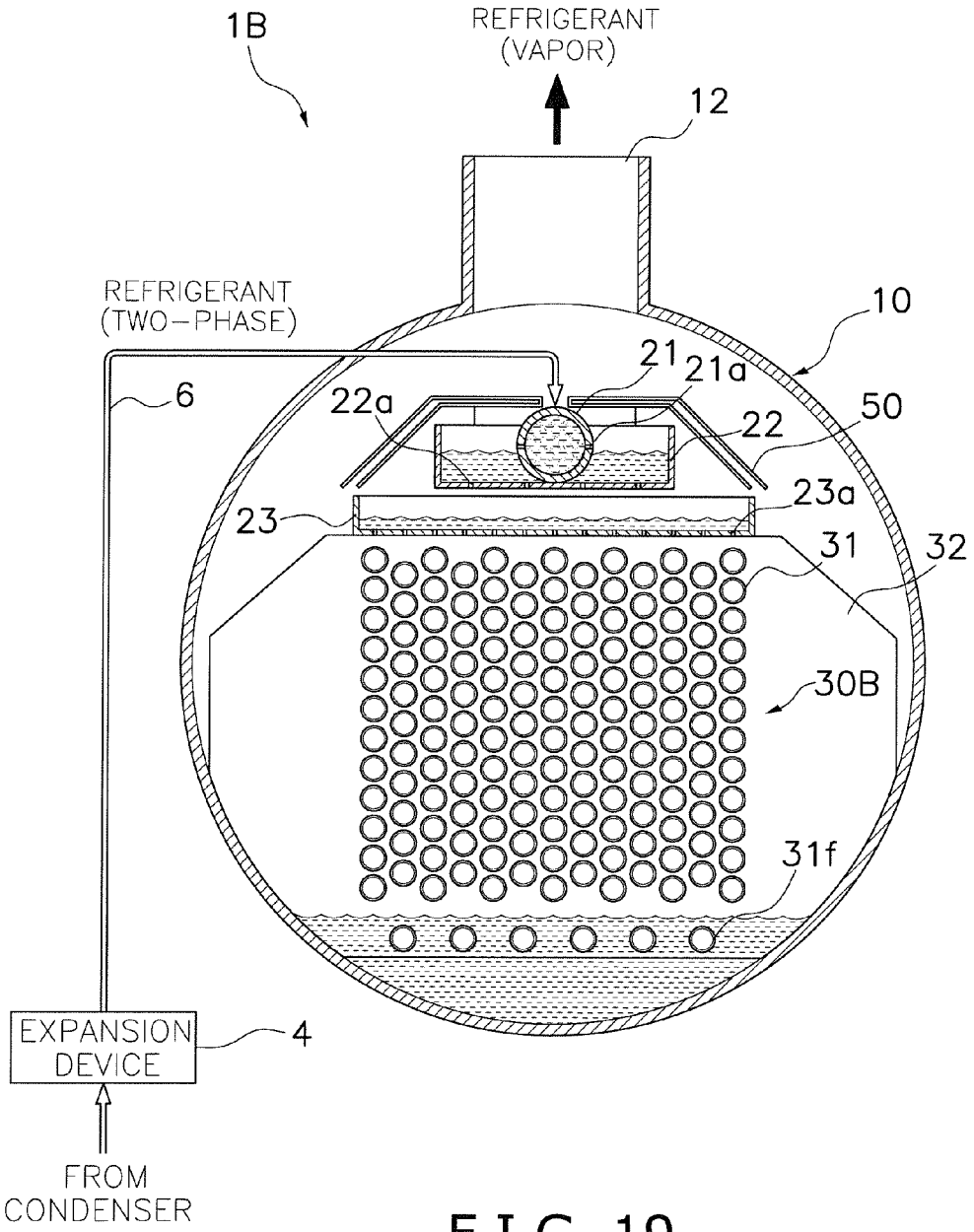
FIG. 19 is a simplified transverse cross sectional view of the heat exchanger illustrating a modified example in which the heat exchanger is provided with a flooded section according to the first embodiment of the present invention.
Figure 20:
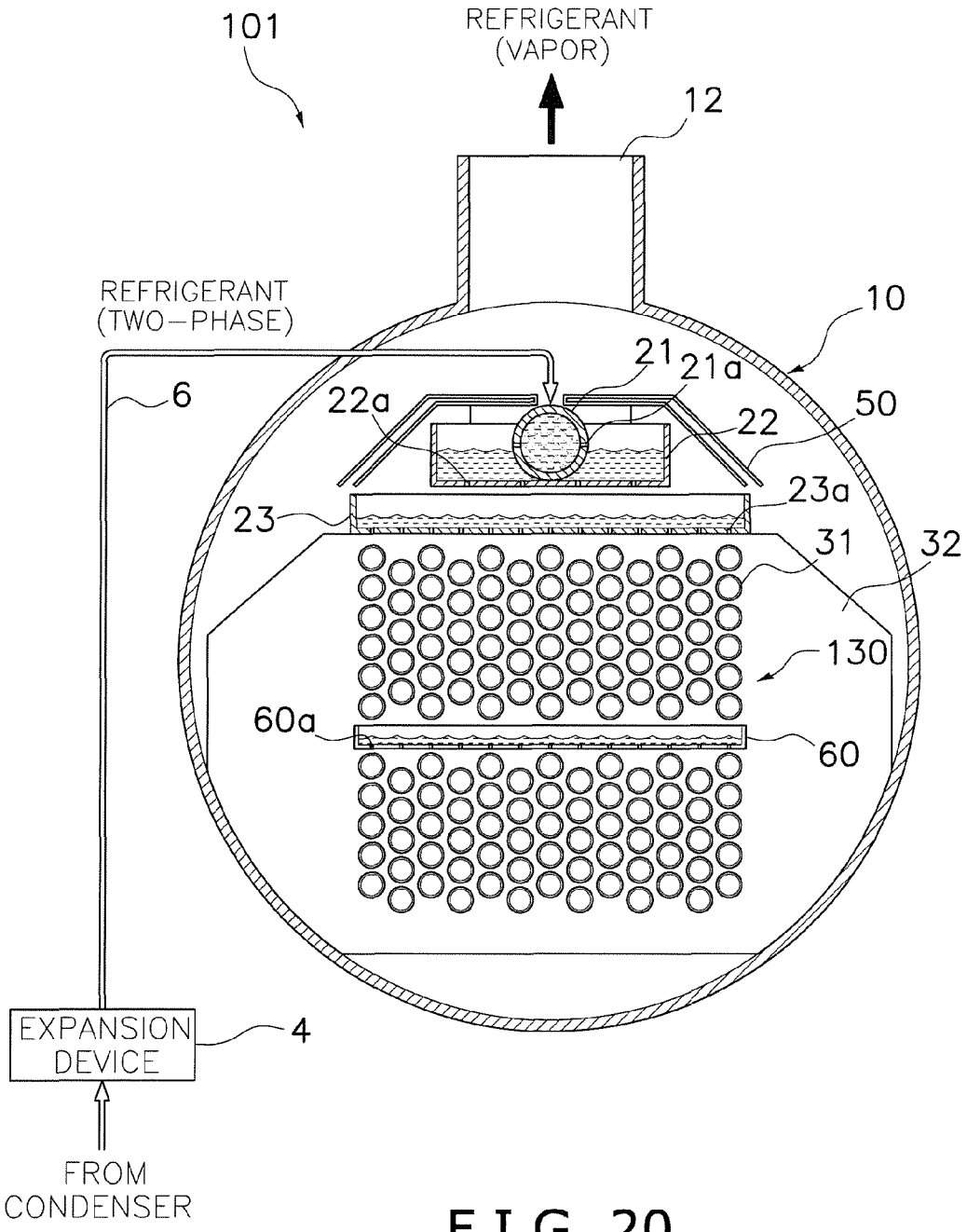
FIG. 20 is a simplified transverse cross sectional view of a heat exchanger according to a second embodiment of the present invention.

Furthermore, an evaporator 1B according to another modified example of the first embodiment may be arranged as a hybrid evaporator that includes a falling film section and a flooded section as shown in FIG. 19. In such a case, a tube bundle 30B further includes a plurality of flooded heat transfer tubes 31*f* that are disposed adjacent to the bottom portion of the shell 10. The flooded heat transfer tubes 31*f* are immersed in a pool of the liquid refrigerant accumulated at the bottom portion of the shell when the evaporator 1 is in use.

Second Embodiment

Referring now to FIGS. 20 to 27, an evaporator 101 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The evaporator 101 of the second embodiment is basically the same as the evaporator 1 of the first embodiment except that an intermediate tray part 60 is provided between the heat transfer tubes 31 in the supply line group of a tube bundle 130 and the heat transfer tubes 31 in the return line group of the tube bundle 130. The intermediate tray part 60 includes a plurality of discharge apertures 60*a* through which the liquid refrigerant is discharged downwardly. The discharge apertures 60*a* may be coupled to spray nozzles or the like that apply refrigerant in a predetermined pattern, such as a jet pattern, onto the heat transfer tubes 31 disposed below the discharge apertures 60*a*.

Figure 21:
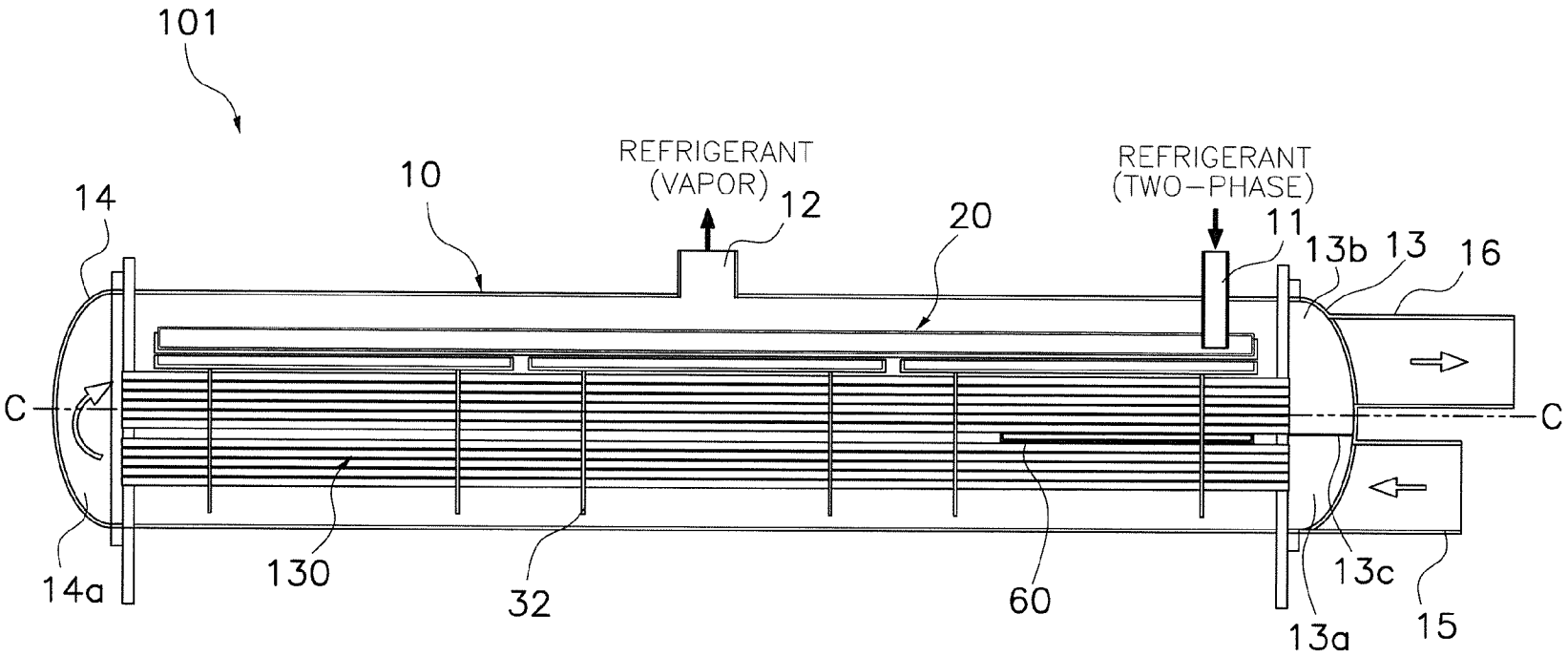
FIG. 21 is a simplified longitudinal cross sectional view of the heat exchanger according to the second embodiment of the present invention.

As discussed above, the evaporator 101 incorporates a two pass system in which the water first flows inside the heat transfer tubes 31 in the supply line group, which is disposed in a lower region of the tube bundle 130, and then is directed to flow inside the heat transfer tubes 31 in the return line group, which is disposed in an upper region of the tube bundle 130. Therefore, the water flowing inside the heat transfer tubes 31 in the supply line group near the inlet water chamber 13*a* has the highest temperature, and thus, a greater amount of heat transfer is required. For example, as shown in FIG. 21, the temperature of the water flowing inside the heat transfer tubes 31 near the inlet water chamber 13*a* is the highest. Therefore, a greater amount of heat transfer is required in the heat transfer tubes 31 near the inlet water chamber 13*a*. Once this region of the heat transfer tubes 31 dries up due to uneven distribution of the refrigerant from the refrigerant distribution assembly 20, the evaporator 301 is forced to perform heat transfer by using limited surface areas of the heat transfer tubes 31 that are not dried up, and the evaporator 301 is held in equilibrium with the pressure at the time. In such a case, in order to rewet the dried up portions of the heat transfer tubes 31, more than the rated amount (e.g., twice as much) of the refrigerant charge will be required.

Therefore, in the second embodiment, the intermediate tray part 60 is disposed at a location above the heat transfer tubes 31 which requires a greater amount of heat transfer. The liquid refrigerant falling from above is once received by the intermediate tray part 60, and redistributed evenly toward the heat transfer tubes 31 disposed below the intermediate tray part 60, which requires a greater amount of heat transfer. Accordingly, these portions of the heat transfer tubes 31 are prevented from drying up, and heat transfer can be efficiently performed by using substantially all surface areas of the exterior walls of the heat transfer tubes 31 in the tube bundle 130.

The total cross-sectional are of the discharge apertures 60*a* of the intermediate tray part 60 is preferably determined as explained above to strike a balance between suppressing the variation in the flow rate and keeping the height of the liquid refrigerant as small as possible.

Figure 22:
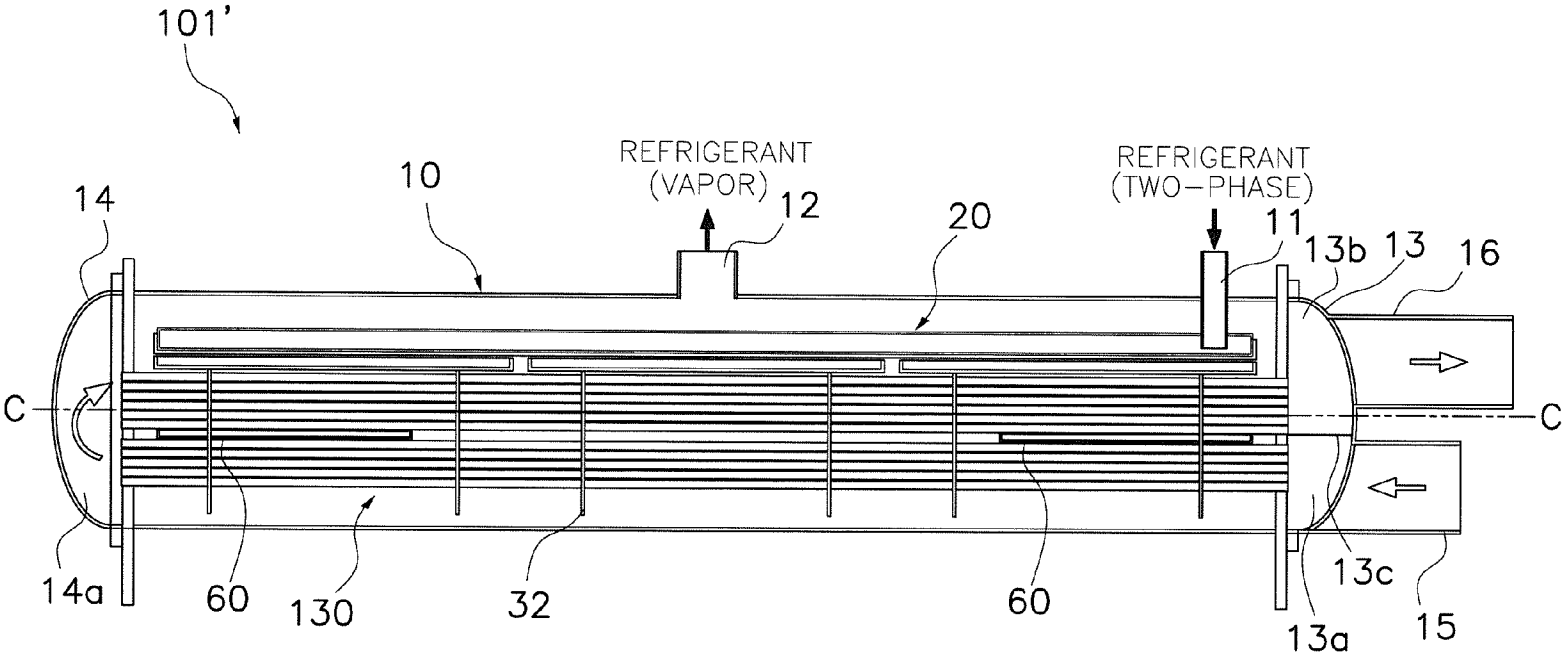
FIG. 22 is a simplified longitudinal cross sectional view illustrating a modified example in which the heat exchanger includes a plurality of intermediate tray parts according to the second embodiment of the present invention.

Although, in FIG. 21, the intermediate tray part 60 is provided only partially with respect to the longitudinal direction of the tube bundle 130, the intermediate tray part 60 or a plurality of intermediate tray parts 60 may be provided to extend substantially over the entire longitudinal length of the tube bundle 130. Moreover, as shown in FIG. 22, a plurality of the intermediate tray parts 60 may be provided in an evaporator 101' so as to be spaced apart from each other in the longitudinal direction. With the arrangement of shown in FIG. 22, even when the positions of the connection head member 13 and the return head member 14 are switched, at least one of the intermediate tray parts 60 is disposed over a location of the tube bundle 130, which requires a greater amount of heat transfer.

In the second embodiment, the refrigerant may be directly supplied to the intermediate tray part 60. In such a case, the portions of the heat transfer tubes 31 disposed below the intermediate tray part 60 can be reliable wetted by ensuring sufficient amount of the refrigerant is supplied to the intermediate tray part.

Figure 23:
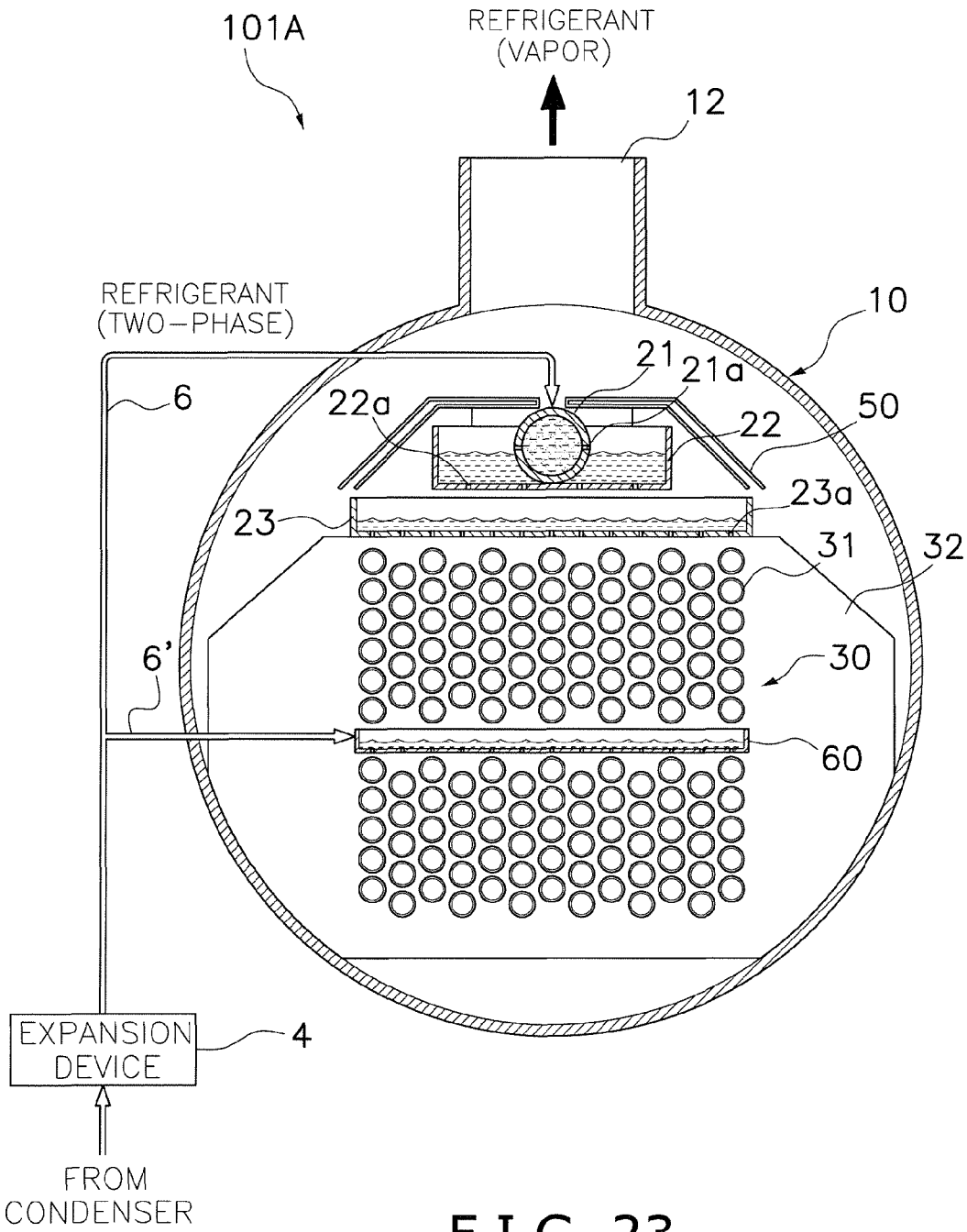
FIG. 23 is a simplified transverse cross sectional view of the heat exchanger illustrating a modified example in which the refrigerant is directly supplied to the intermediate tray part from the refrigeration circuit according to the second embodiment of the present invention.

For example, as shown in FIG. 23, an evaporator 101A may include a refrigerant circuit having a conduit 6', which branches out from the conduit 6. The conduit 6' is fluidly connected to the intermediate tray part 60 so that the refrigerant is directly supplied to the intermediate tray part 60 from the expansion valve 4.

Figure 24:
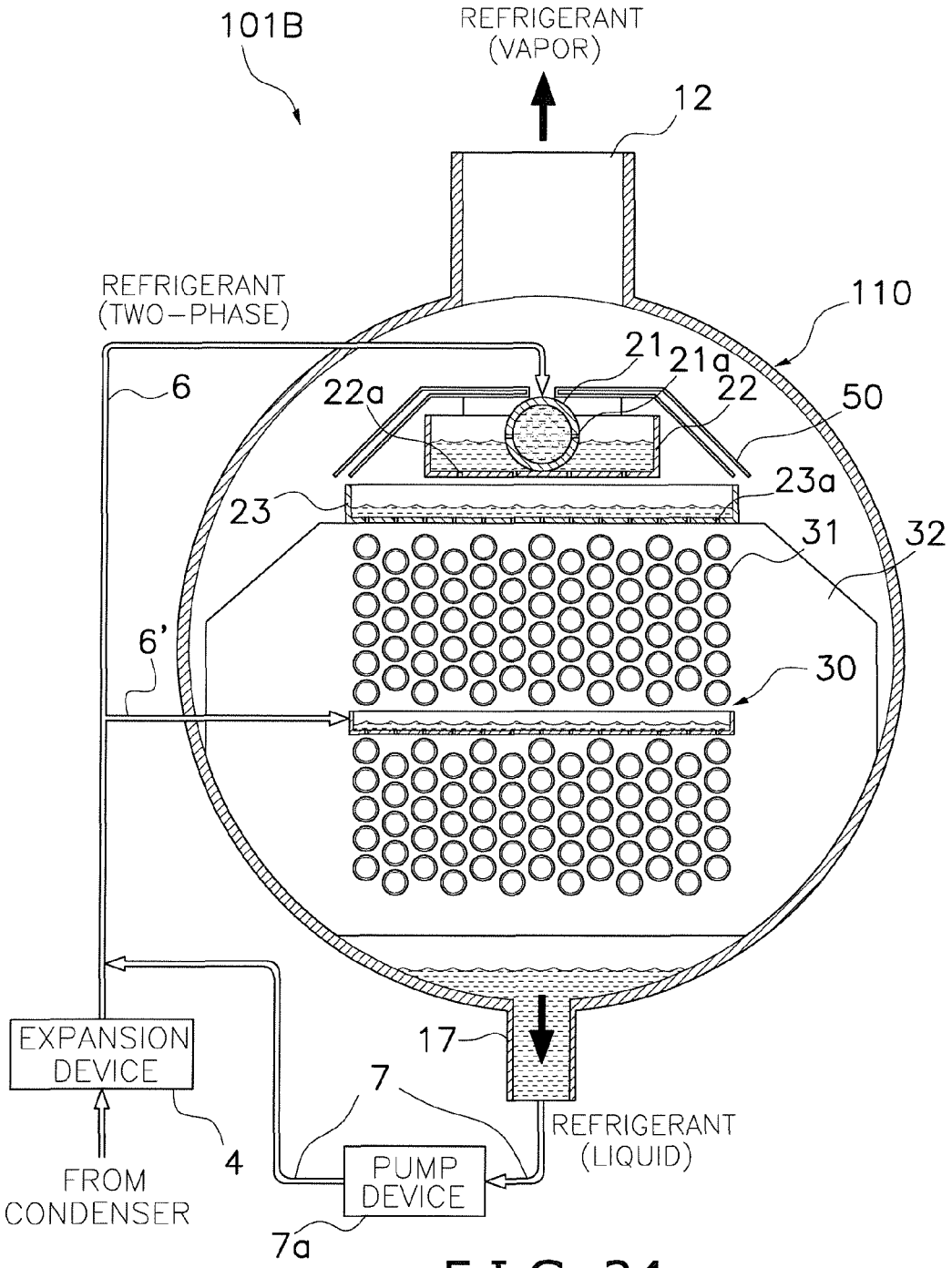
FIG. 24 is a simplified transverse cross sectional view of the heat exchanger illustrating a modified example in which the heat exchanger is provided with a refrigerant recirculation system according to the second embodiment of the present invention.

Moreover, as shown in FIG. 24, an evaporator 101B may be provided with a refrigerant recirculation system. More specifically, a shell 110 may include a bottom outlet pipe 16 in fluid communication with a conduit 7 that is coupled to a pump device 7*a*. The pump device 7*a* is selectively operated so that the liquid refrigerant accumulated in the bottom portion of the shell 10 recirculates back to the distribution part 20 of the evaporator 10 via the conduit 6 and to the intermediate tray part 60 via the conduit 6'. The bottom outlet pipe 17 may be placed at any longitudinal position of the shell 110.

Figure 25:
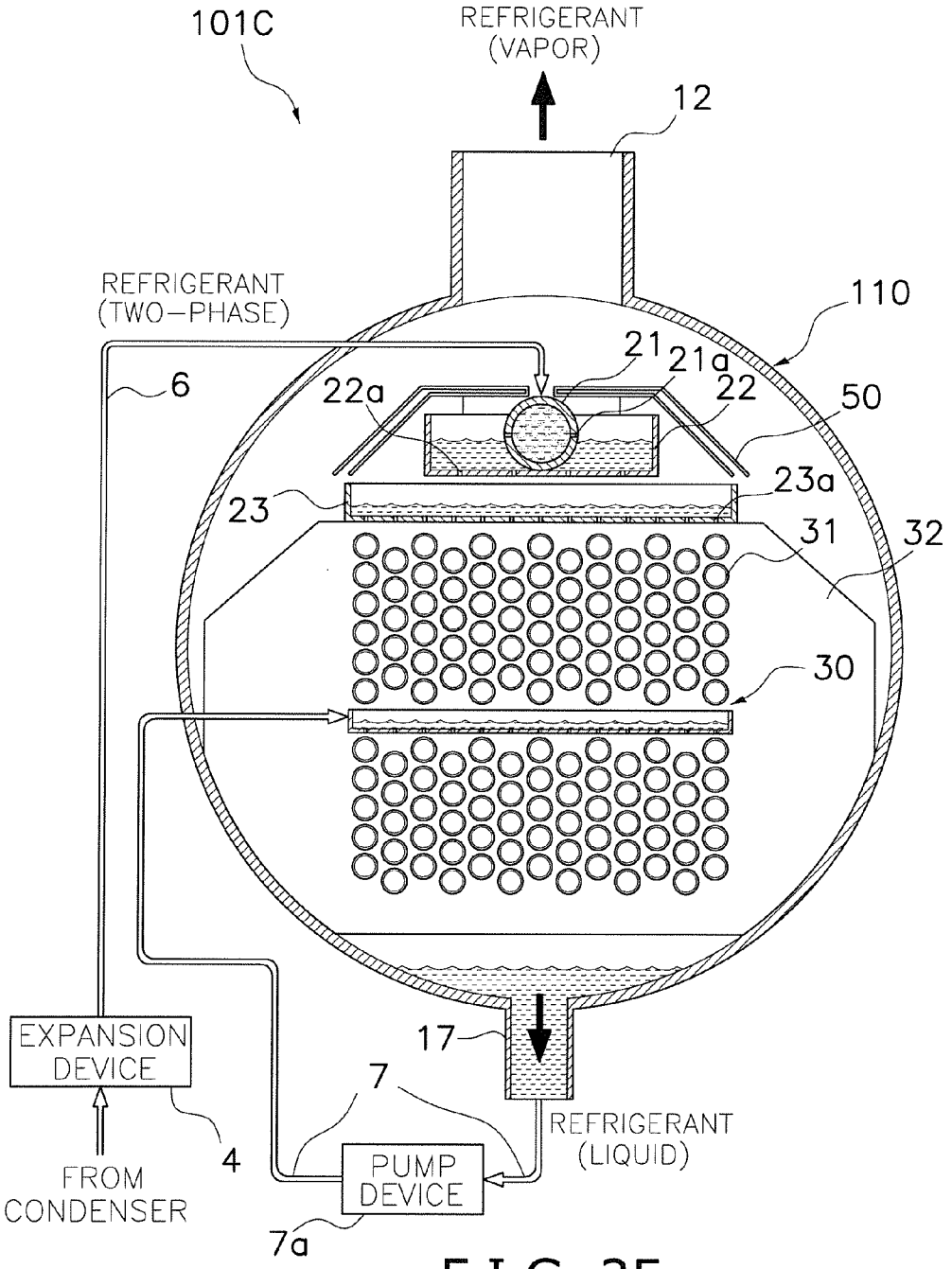
FIG. 25 is a simplified transverse cross sectional view of the heat exchanger illustrating a modified example in which the heat exchanger is provided with a refrigerant recirculation system and the recirculated refrigerant is supplied to the intermediate tray part according to the second embodiment of the present invention.
Figure 26:
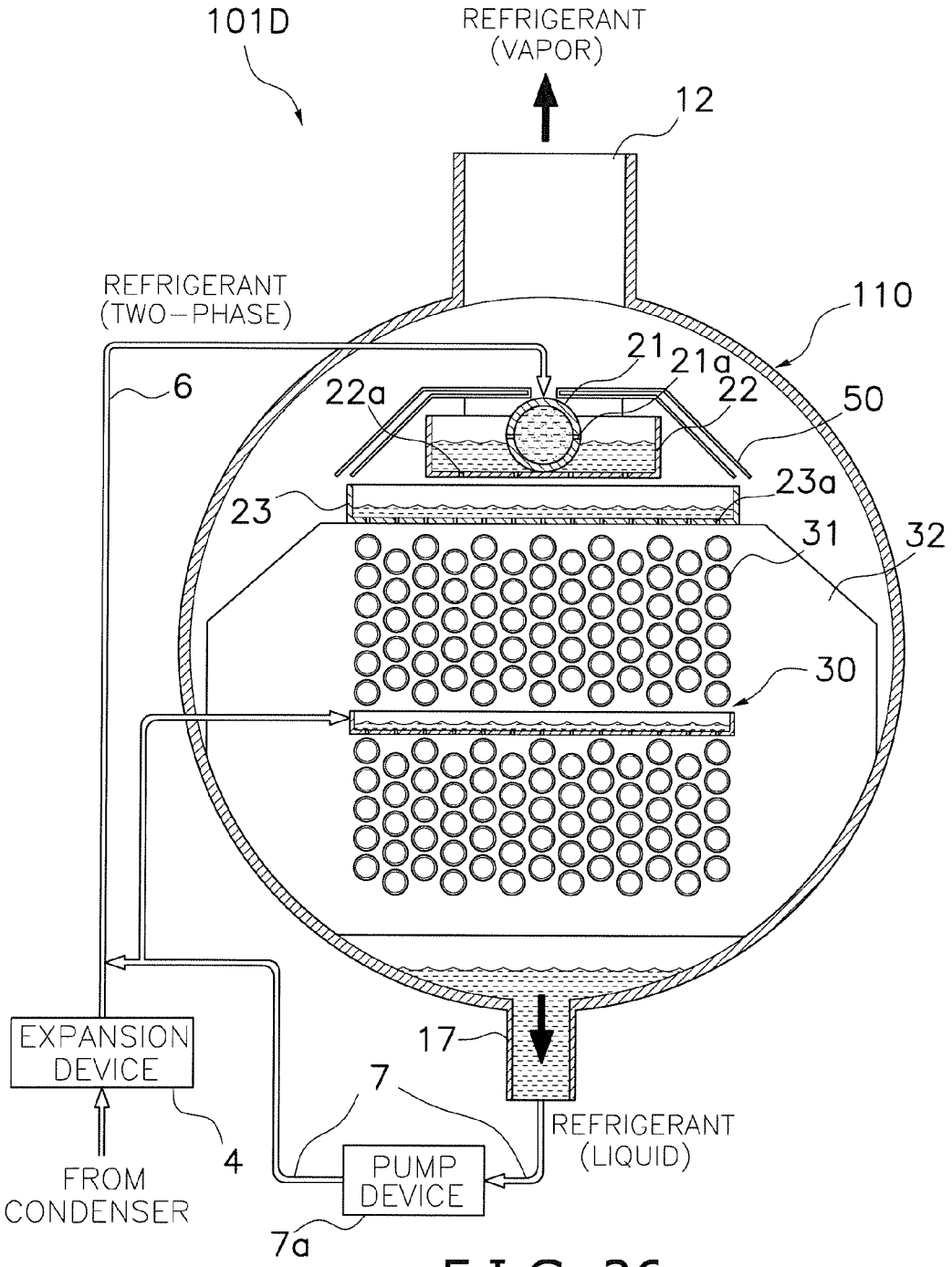
FIG. 26 is a simplified transverse cross sectional view of the heat exchanger illustrating a modified example in which the heat exchanger is provided with a refrigerant recirculation system and the recirculated refrigerant is supplied to a refrigerant distribution assembly and the intermediate tray part according to the second embodiment of the present invention.

Moreover, an evaporator 101C may include the refrigerant recirculation system that directly supplies the recirculated refrigerant only to the intermediate tray part 60 as shown in FIG. 25. Alternatively, an evaporator 101 D may include the refrigerant recirculation system in which a part of the recirculated refrigerant is directly supplied to the intermediate tray part 60 as shown in FIG. 26. In the examples shown in FIGS. 25 and 26, the refrigerant in a liquid state is supplied to the intermediate tray part 60. Therefore, as compared to the example shown in FIG. 24, in which the refrigerant in a two-phase state is supplied to the intermediate tray part 60, the liquid refrigerant can be supplied stably to the intermediate tray part 60 in the examples shown in FIGS. 25 and 26.

Figure 27:
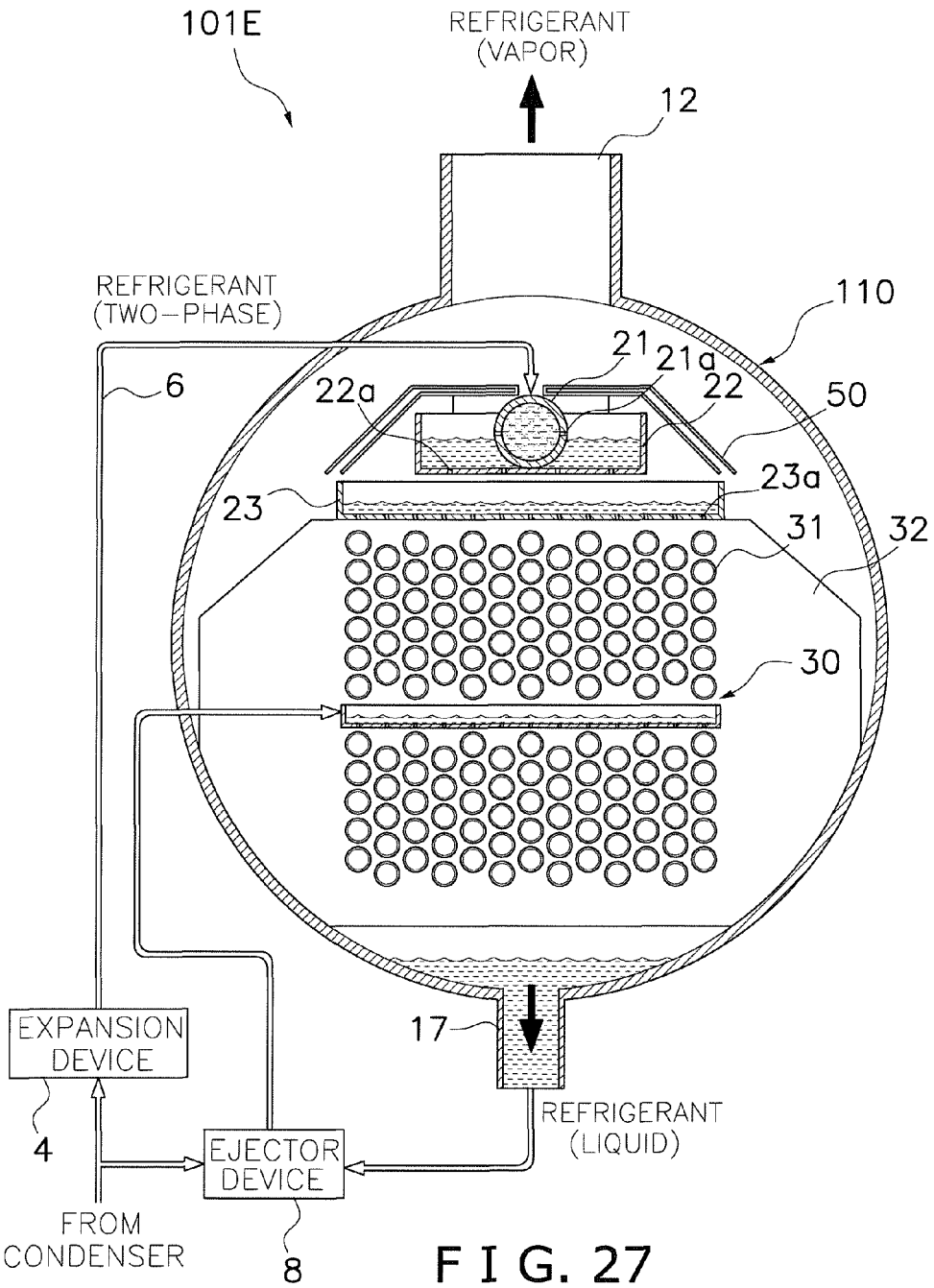
FIG. 27 is a simplified transverse cross sectional view of the heat exchanger illustrating a modified example in which the heat exchanger is provided with a refrigerant recirculation system including an ejector device according to the second embodiment of the present invention.

Furthermore, as shown in FIG. 27, an evaporator 101E may include an ejector device 8, which operates on Bernoulli's principal to draw the liquid refrigerant accumulated in the bottom portion of the shell 10 using the pressurized refrigerant from the condenser 2. The ejector device 8 combines the functions of an expansion device and a pump, and thus, the expansion device 4 may be omitted when an ejector device is used. In such a case, the pressurized refrigerant from the compressor 2 enters the ejector device, and the depressurized refrigerant from the ejector device is supplied to the conduit 6. When the ejector device 8 is used, it is desirable that the pressure loss in the evaporator is as small as possible because differential pressure across the ejector device 8 is not large. With the refrigerant distribution assembly 20 of the illustrated embodiments, the pressure loss can be suppressed by using the first tray part 22 and the second tray parts 23. Therefore, the refrigerant distribution assembly 20 according to the illustrated embodiments is suitably used in a system utilizing the ejector device 8 as shown in FIG. 27.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of an evaporator when a longitudinal center axis thereof is oriented substantially horizontally as shown in FIGS. 6 and 7. Accordingly, these terms, as utilized to describe the present invention should be interpreted relative to an evaporator as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A heat exchanger adapted to be used in a vapor compression system, comprising:

a shell with a longitudinal center axis extending generally parallel to a horizontal plane;

a refrigerant distribution assembly including a first tray part disposed inside of the shell and continuously extending generally parallel to the longitudinal center axis of the shell to receive a refrigerant that enters the shell, the first tray part having a plurality of first discharge apertures disposed in a bottom surface of the first tray part, a top of the first tray part being open to a space inside of the shell;

a plurality of second tray parts disposed inside of the shell below the first tray part to receive the refrigerant discharged from the first discharge apertures such that the refrigerant accumulated in the second tray parts does not communicate between the second tray parts, the second tray parts being aligned along a direction generally parallel to the longitudinal center axis of the shell, each of the second tray parts having a plurality of second discharge apertures; and a heat transferring unit disposed inside of the shell below the second tray parts so that the refrigerant discharged from the second discharge apertures of the second tray parts is supplied to the heat transferring unit, wherein the refrigerant distribution assembly further includes an inlet part having an inlet pipe part extending generally parallel to the longitudinal center axis of the shell, at least the bottom surface of the first tray part is disposed below the inlet pipe part, and no vertical gap is formed between the bottom surface of the first tray part and the inlet pipe.

2. The heat exchanger according to claim 1, wherein a total cross-sectional area of the second discharge apertures of the second tray parts is larger than a total cross-sectional area of the first discharge apertures of the first tray part.

3. The heat exchanger according to claim 2, wherein the total cross-sectional area of the second discharge apertures of the second tray part is more than 1.2 times of the total cross-sectional area of the first discharge apertures of the first tray parts.

4. The heat exchanger according to claim 3, wherein the total cross-sectional area of the second discharge apertures of the second tray part is more than 1.5 times of the total cross-sectional area of the first discharge apertures of the first tray parts.

5. The heat exchanger according to claim 1, wherein a longitudinal length of the first tray part is substantially the same as an overall longitudinal length of the second tray parts.

6. The heat exchanger according to claim 1, wherein a longitudinal length of each of the second tray parts is substantially the same.

7. The heat exchanger according to claim 1, wherein a number of the second tray parts is three or more.

8. The heat exchanger according to claim 1, wherein the second tray parts are spaced apart from each other in a longitudinal direction of the shell.

9. The heat exchanger according to claim 1, wherein the second tray parts are integrally formed as one piece, unitary member.

10. The heat exchanger according to claim 1, wherein the heat transferring unit has a tube bundle including a plurality of heat transfer tubes extending generally parallel to the longitudinal center axis of the shell.

11. The heat exchanger according to claim 10, wherein the second discharge apertures of the second tray parts are arranged at positions corresponding to positions of the heat transfer tubes.

12. The heat exchanger according to claim 10, further comprising a third tray part disposed in a gap formed between an upper portion and a lower portion of the tube bundle to receive the refrigerant that drips down from the heat transfer tubes in the upper portion of the tube bundle.

13. The heat exchanger according to claim 12, further comprising a longitudinal length of the third tray part is smaller than a longitudinal length of the first tray part.

14. The heat exchanger according to claim 13, wherein the third tray part is disposed adjacent to one of longitudinal end portions of the tube bundle.

15. The heat exchanger according to claim 12, further comprising an additional third tray part disposed in the gap formed between the upper portion and the lower portion of the tube bundle to receive the refrigerant that drips down from the heat transfer tubes in the upper portion of the tube bundle, the third tray part and the additional third tray part being spaced apart from each other in the direction parallel to the longitudinal center axis of the shell so that the third tray part and the additional third tray part are respectively disposed adjacent to longitudinal end portions of the tube bundle.

16. The heat exchanger according to claim 12, further comprising a supply conduit configured and arranged to supply the refrigerant to the shell, and a branching conduit branching out from the supply conduit and fluidly connected to the third tray part to supply the refrigerant to the third tray part.

17. The heat exchanger according to claim 12, further comprising a recirculation conduit fluidly connecting an opening formed on a bottom surface of the shell and the third tray part to recirculate the refrigerant accumulated in a bottom portion of the shell into the third tray part.

18. The heat exchanger according to claim 17, further comprising an ejector device disposed in the recirculating conduit.

19. The heat exchanger according to claim 10, wherein the tube bundle includes a plurality of flooded heat transfer tubes disposed adjacent to a bottom portion of the shell so that the flooded heat transfer tubes are completely immersed in the refrigerant during operation of the heat exchanger.

20. The heat exchanger according to claim 1, further comprising a supply conduit configured and arranged to supply the refrigerant to the shell, and a recirculation conduit fluidly connected to an opening formed on a bottom surface of the shell to recirculate the refrigerant accumulated in a bottom portion of the shell into the supply conduit.

21. The heat exchanger according to claim 20, further comprising a branching conduit branching out from the supply conduit and fluidly connected to the third tray part to supply the refrigerant to the third tray part.

* * * * *